US007470290B2

(12) United States Patent
Rodrigues et al.

(10) Patent No.: US 7,470,290 B2
(45) Date of Patent: Dec. 30, 2008

(54) HYDROSCOPIC POLYMER GELS FOR EASIER CLEANING

(75) Inventors: Klin A. Rodrigues, Bridgewater, NJ (US); David R. Scheuing, Oakland, CA (US); Michael H. Robbins, Oakland, CA (US); Nicholas Pivonka, Oakland, CA (US); David L. Budd, Oakland, CA (US); Malcolm A. Deleo, Oakland, CA (US)

(73) Assignee: The Clorox Company, Oakland, CA (US)

( * ) Notice: Subject to any disclaimer, the term of this patent is extended or adjusted under 35 U.S.C. 154(b) by 440 days.

(21) Appl. No.: 11/176,472

(22) Filed: Jul. 6, 2005

(65) Prior Publication Data

US 2005/0245428 A1 Nov. 3, 2005

Related U.S. Application Data

(63) Continuation-in-part of application No. 10/263,605, filed on Oct. 2, 2002, now Pat. No. 6,926,745, which is a continuation-in-part of application No. 10/150,363, filed on May 17, 2002, now abandoned.

(51) Int. Cl.
*D06M 10/08* (2006.01)
*B05D 1/00* (2006.01)
*C11D 3/37* (2006.01)

(52) U.S. Cl. ..... 8/115.51; 8/181; 8/115.54; 510/475; 427/155; 427/421.1; 134/42

(58) Field of Classification Search ..... 8/115.51, 8/181, 115.54; 510/475; 427/155, 421.1; 134/42

See application file for complete search history.

(56) References Cited

U.S. PATENT DOCUMENTS

| | | | | |
|---|---|---|---|---|
| 2,798,047 | A | | 7/1957 | Touey et al. |
| 4,622,075 | A | | 11/1986 | Bogner |
| 5,403,883 | A | | 4/1995 | Messner et al. |
| 5,409,639 | A | | 4/1995 | Fusiak et al. |
| 5,547,612 | A | | 8/1996 | Austin et al. |
| 5,693,716 | A | | 12/1997 | Bott et al. |
| 5,874,495 | A | * | 2/1999 | Robinson ..... 524/300 |
| 6,242,046 | B1 | | 6/2001 | Nakane et al. |
| 6,251,849 | B1 | * | 6/2001 | Jeschke et al. ..... 510/470 |
| 6,331,517 | B1 | | 12/2001 | Durbut |
| 6,433,053 | B1 | | 8/2002 | Kasturi et al. |
| 2003/0017960 | A1 | | 1/2003 | Bertrem et al. |
| 2003/0045439 | A1 | | 3/2003 | Evers |

FOREIGN PATENT DOCUMENTS

| | | | |
|---|---|---|---|
| EP | 0 467 472 A2 | | 1/1992 |
| EP | 0 859 046 B1 | | 8/1998 |
| GB | 2 104 091 A | | 3/1983 |
| WO | WO 96/00251 | | 4/1996 |
| WO | WO 97/20908 | * | 6/1997 |
| WO | WO 00/29538 | | 5/2000 |
| WO | WO 00/77143 | | 12/2000 |
| WO | WO 01/05920 | | 1/2001 |
| WO | WO 02/18531 | | 3/2002 |

* cited by examiner

*Primary Examiner*—Brian P Mruk
(74) *Attorney, Agent, or Firm*—Monica Winghart; Michael Petrin; David Peterson

(57) ABSTRACT

Hydroscopic polymer gels can be formed by applying a polymer to a surface and allowing water to be sequestered from the atmosphere into the polymer. The polymer gels are formed using methods and compositions employing water soluble or water dispersible copolymers having: (i) a first monomer that is acidic and is capable of forming an anionic charge in the composition; (ii) a second monomer that is amphipathic; (iii) optionally, a third monomer that is hydrophobic; and (iv) optionally, a fourth monomer that that has a permanent cationic charge or that is capable of forming a cationic charge on protonation. The polymer gels are particularly substantive and effective at modifying surfaces such as glass and hydrophobic polymeric substrates to provide soap scum and soil resistance, and easier next time cleaning benefits.

40 Claims, No Drawings

HYDROSCOPIC POLYMER GELS FOR EASIER CLEANING

REFERENCE TO RELATED APPLICATIONS

This application is a continuation-in-part application of U.S. patent application Ser. No. 10/263,605 filed on Oct. 2, 2002, which has issued as U.S. Pat. No. 6,926,745, which is a continuation-in-part of U.S. patent application Ser. No. 10/150,363 filed on May 17, 2002, now abandoned, all of which are incorporated herein in their entirety.

FIELD OF THE INVENTION

The invention is directed to a hydroscopic polymer containing treatment and/or cleaning composition for hard surfaces whereby treated surfaces exhibit excellent water-spreading, water hardness and soap scum repellency even after the surfaces have been rinsed several times with water. Thus treated household surfaces and articles, for example, will remain clean for a longer period of time. The hydroscopic polymers can be adsorbed on the surface and modify the properties of the surface through the formation of polymer gels containing water that is drawn from the ambient environment.

BACKGROUND OF THE INVENTION

Consumers are dissatisfied with their cleaner's ability to prevent soils, such as soap scum, toothpaste, hard water, greasy soils, brake dust, grime, rust, and toilet ring, from building up on household surfaces and articles. Specifically, consumers want surfaces to maintain their cleaned look for longer periods of time.

One approach to solving this problem entails applying a sacrificial layer of material which is dissolvable by water with the attendant removal of dirt. Suitable cleaning formulations must be carefully applied in order to create a sufficiently thick, dry sacrificial film. Unfortunately, inconsistent consumer cleaning habits make this an almost impossible task. In many cases, the surface is rinsed before the film is dried thereby creating a sacrificial coating that is too thin to prevent soils from adhering. In cases where the sacrificial coating is too thick, an unsightly macroscopic film with visible residue is created.

U.S. Pat. No. 6,331,517 to Durbut describes an aqueous glass cleaning composition comprising an anionic surfactant and a hydrophilic, anionic maleic acid-olefin copolymer. The surface becomes hydrophilic such that the initial contact angle of water on the treated surface is from 12 to 23 degrees. While the presence of the copolymer yields an efficient hydrophilic surface coating, this sacrificial coating is easily rinsed away unless it is very thick. U.S. Pat. No. 6,242,046 to Nakane et al. describes a more permanent stain-proofing treatment that employs a non-water soluble resin and a metal oxide sol. With this treatment, the surface must be washed with water before the film dries on the surface. This step appears to homogeneously spread a stainproof-treating agent on the surface and removes excess stainproof-treating agents. When washing with water is not done properly, however, the excess causes surface nonuniformity. WO 00/77143 to Sherry et al. describes a surface substantive polymer which purportedly renders treated surfaces hydrophilic. The preferred polymers include a copolymer of N-vinylimidazole N-vinylpyrrolidone (PVPVI), a quaternized vinyl pyrrolidone/dialkylaminoalkyl acrylate or methacrylate copolymer, or a polyvinylpyridine-N-oxide homopolymer. These polymers are purported to modify the surface to achieve water to treated surface contact angles of less than 50 degrees.

U.S. Pat. No. 6,251,849 to Jeschke et al. describes a cleaner for easier next time cleaning that contains a cationic polymer comprising at least 40 mole percent of a quaternary monomer such as methacrylamidopropyl trimethylammonium chloride. The cleaning performance is said to improve with the presence of these polymers in the cleaner but it is expected that the wetting properties will decline after a single rinse step.

A second approach to preventing soil buildup is to deposit a release aid on the treated surface to modify surface characteristics. Unfortunately, the application of cleaner or water causes the soluble release aid to be completely removed. WO 02/18531 to Ashcroft et al. describes the use of cleaning solutions containing antioxidants that function as soil release agents. The antioxidants are purportedly retained on the surface so that soil subsequently deposited thereon is prevented from polymerizing thereby allowing for easier removal. However, it is expected that the antioxidants will not be effective on all soil types. WO 00/29538 to Baker et al. describes a non-greasy sacrificial coating containing cellulose or gum and a release aid, such as lecithin. While this coating prevents sticking, its visual appearance makes it unsuitable for glass, counter-tops, showers and the like.

In view of the deficiencies of past endeavors in developing cleaning compositions that leave satisfactory low maintenance treated surfaces, the art is in search of cleaning compositions that provide a thin, stable invisible film that facilitates removal of a variety of soils. The cleaning composition should be suitable for household surfaces and should be rapidly adsorbed on the surface to yield a uniform film that causes water to sheet off and oil to roll off.

SUMMARY OF THE INVENTION

For the present invention, it has been determined that liquid water plays a critical role in the performance of the cleaning compositions, especially in decreasing the adhesion of soils to surfaces, including hydrophobic polymeric surfaces such as plastics and other similar polymeric substrates, and that the source of this water can be the atmosphere. The hydroscopic polymer containing cleaning compositions of the present invention can be used not only for modifying surfaces with the goals of making cleaning easier, but also with the goal of providing invisible layers containing water, thereby maintaining or changing the water content of the surface for a variety of uses.

The present invention is based in part on the discovery of that certain hydroscopic polymers can adsorb onto a surface and subsequently modify the properties of the surface through the formation of films containing water that is drawn from the ambient atmosphere. Simple water solutions or complex cleaning formulations can be the vehicles by which the polymers are delivered to the surfaces. The very thin films comprising the hydroscopic polymers and atmospheric water are very hydrophilic, resulting in low contact angles of drops of water placed on them. Surprisingly, although the polymers rapidly adsorb water from the atmosphere and produce hydrophilic films, nevertheless, they resist removal from surfaces when rinsed with liquid water. These films can therefore be considered to be water-rich polymer gels.

The hydroscopic polymer gels can be used in a variety of ways. The presence of water in the films results in an increase in the interfacial tension and a lowered total energy of adhesion between many common household soils such as soap scum, hydrocarbon greases, or triglyceride greases and the treated polymeric surface. The formation of the thin polymer gels interferes with the wetting of the surface by household soils, resulting in much improved, easier cleaning of the surface with subsequent exposure of the surface to liquid water which occurs, for instance, through ordinary rinsing with water, or wiping with a wet towel, cloth, or sponge, but in the absence of any cleaning agents such as surfactants.

Similarly, the surfaces of textiles, woven and non-woven, paper, and related materials can be engineered by the formation of hydroscopic polymer gels so that such items maintain a more constant surface energy, which result from the presence of water in the polymer gels on the surfaces of the fibers, including those fibers composed in part or in whole of synthetic polymeric materials and/or synthetically modified natural polymers. The hydrophilic nature of the polymer gel also reduces the build-up of static charges on surfaces coated therewith. Fibers modified by the presence of the hydroscopic polymer gels can become more receptive to interaction with aqueous solutions or formulations (in the case of wet cleaning wipes) containing pigments, dyes, water-soluble ions, other water-soluble polymers, surfactants, and the like. Conversely, the presence of the polymer gels on the fibers decreases wetting and adhesion of oily or greasy materials such as household soils, non-water soluble dyes, pigments, and/or fragrances onto the fibers.

Thus, the present invention affords a technique to produce extremely thin polymer gels that contain water on targeted surfaces and substrates, including many common materials found in and around the home such as glass, metal, ceramic and also plastic and similar polymeric substrates and articles composed of these materials. The hydroscopic polymer gels can be the sites of chemical reactions between materials that occur in water, or in solvents that are miscible with water, thereby localizing the reactants and products within the polymer gels.

The present invention relates to a method of forming a hydroscopic polymer gel on a surface that comprises: (a) applying a water soluble or water dispersible polymer on the surface to form a layer of the polymer on the surface; and (b) allowing water to be sequestered to the layer to form the polymer gel, wherein said polymer comprises: (1) a water soluble or water dispersible copolymer having: (i) a first monomer that is acidic and that is capable of forming an anionic charge in the composition; and (ii) a second monomer that is amphipathic; and (iii) optionally, a third monomer that is hydrophobic; and (iv) optionally, a fourth monomer that that has a permanent cationic charge or that is capable of forming a cationic charge on protonation.

The present invention further relates to methods for treating a surface with a copolymer to form a hydroscopic polymer gel on the treated article that is extremely thin and not visible to an unaided human eye. The present invention further relates to methods of treating the surface to provide protection benefits thereto including resistance against wetting by oil, lowered energy of adhesion of an oil, and increased hydrophilicity, any one or more of which benefits provides for easier cleaning, easier next time cleaning, reduced cleaning effort and/or self-cleaning characteristics of the surface bearing the hydroscopic polymer gel.

The present invention further relates to methods for forming a polymer gel on a surface that exhibits a Substantivity Score of equal to or greater than 1 to about 15, and/or a Soap Scum Repellency Score of greater than 1 to 5.

There are numerous, non-limiting embodiments of the invention. All embodiments, even if they are only described herein as being "embodiments" of the invention, are intended to be non-limiting, in that there may be other embodiments in addition to these, unless they are expressly described as limiting the scope of the invention.

In one non-limiting embodiment, the present invention is a method of forming a hydroscopic polymer gel on a surface that comprises: (a) applying a water soluble or water dispersible polymer on the surface to form a layer of the polymer on the surface; and (b) allowing water to be sequestered to the layer to form the polymer gel, wherein said polymer comprises: (1) a water soluble or water dispersible copolymer having: (i) a first monomer that is acidic and that is capable of forming an anionic charge in the composition; and (ii) a second monomer that is amphipathic; and (iii) optionally, a third monomer that is hydrophobic; and (iv) optionally, a fourth monomer that that has a permanent cationic charge or that is capable of forming a cationic charge on protonation.

In another non-limiting embodiment, the present invention is a method of forming a hydroscopic polymer gel on a surface that comprises: (a) applying a composition comprising a water soluble or water dispersible polymer on the surface to form a layer of the polymer on the surface; and (b) allowing water to be sequestered to the layer to form the polymer gel, wherein said polymer comprises: (1) a water soluble or water dispersible copolymer having: (i) a first monomer that is acidic and that is capable of forming an anionic charge in the composition; and (ii) a second monomer that is amphipathic; and (iii) optionally, a third monomer that is hydrophobic; and (iv) optionally, a fourth monomer that that has a permanent cationic charge or that is capable of forming a cationic charge on protonation, wherein said composition may further include an aqueous carrier, and/or optionally an organic solvent, and/or optionally an adjuvant.

In yet another non-limiting embodiment, the present invention is a method of allowing the formation of hydroscopic polymer gel on a surface in contact with an aqueous system that comprises a water soluble or water dispersible polymer which comprises: (1) a water soluble or water dispersible copolymer having: (i) a first monomer that is acidic and that is capable of forming an anionic charge in the composition; and (ii) a second monomer that is amphipathic; and (iii) optionally, a third monomer that is hydrophobic; and (iv) optionally, a fourth monomer that that has a permanent cationic charge or that is capable of forming a cationic charge on protonation.

In yet a further non-limiting embodiment is a method of forming a hydroscopic polymer gel on a surface that comprises: (a) applying a water soluble or water dispersible polymer to the surface to form a layer of the polymer on said surface; and (b) allowing water to be sequestered to the layer to form the polymer gel, wherein said polymer comprises: (1) a water soluble or water dispersible copolymer having: (i) a first monomer that is acidic and that is capable of forming an anionic charge in the composition; and (ii) a second monomer that is amphiphatic having the formula $$[A]_nB(C)_mLW \qquad \text{I}$$

wherein A comprises a hydrophobic radical having n total number of carbon atoms; n being from 4 to 100; wherein A comprises a branched hydrocarbon radical subunit selected from the group consisting an alkyl, alkylene, aryl, alkylaryl, benzyl, phenyl, polycyclic aromatic hydrocarbons, and/or derivatives thereof; wherein B comprises an interatomic bond or a linkage group selected from —O—, —S—, —C(O)—, —C(O)C(O)—, —C(O)$CH_2$C(O)—, —NR1C(O)—, —C(O)O—, —OC(O)—, —C(O)O$(CH_2)_p$— and —(CH2)$_p$—; p being from 1 to 6; $(C)_m$ comprising a hydrophilic moiety selected from —NH—, —SH—, —C(O)O—, —OC(O)—, —C(O)O$(CH_2)_p$— and —O—[(CR1R2)$_i$—O]$_j$—; m being from 1 to 5; i being from 1 to 3; j being from 1 to about 50; wherein L comprises a tether group selected from —C(O)—, —C(O)C(O)—, —C(O)$CH_2$C(O)—, —NR1C(O)—, —C(O)O—, —OC(O)—, —C(O)O$(CH_2)_p$— and —$(CH_2)_p$—; wherein W comprises a polymerizable alkylene group selected from —(R1C═CR2)— and (R1R2C═CR3)—; wherein R1, R2, R3 are independently selected from —H, —$CH_3$ and —$(CH_2)_k$—, —X, and phenyl; k being from 1 to about 6; wherein X is selected from Cl, F, Br and I; wherein the ratio of the molar mass of A to molar mass of C is between 10:1 and 1:10; and (iii) optionally, a third monomer that is hydrophobic; and (iv) optionally, a fourth monomer that that has a permanent cationic charge or that is capable of forming a cationic charge on protonation.

In yet another non-limiting embodiment of the present invention is a treated article comprising: (a) a polymeric substrate; and (b) a hydroscopic polymer gel formed on a surface of said polymeric substrate, wherein said hydroscopic polymer gel comprises a water-soluble or water-dispersible copolymer comprising: (i) a first monomer that is acidic and that is capable of forming an anionic charge in the composition; and (ii) a second monomer that is amphipathic; and (iii) optionally, a third monomer that is hydrophobic; and (iv) optionally, a fourth monomer that that has a permanent cationic charge or that is capable of forming a cationic charge on protonation, wherein said treated article exhibits a exhibits a Soap Scum Repellency score of greater than 1 to 5.

It is desirable that the aqueous compositions of the present invention are formulated and applied so that a very thin film of hydroscopic polymer gel that is not visible to the unaided eye eventually develops on the polymeric surface. Typically, the polymer gel has a thickness in the range of 0.5 nm to 500 nm, and are thus not visible to the eye even when present on highly reflective, glossy or matte surfaces. In a particular non-limiting embodiment, the polymer gels are approximately a monolayer thick, or even less. The polymer gels, even if present on the order of being several molecules thick, are not visible to the unaided eye, and hence the appearance of surfaces modified with the inventive copolymers is not altered.

In one suitable non-limiting embodiment, the proper formulation of the polymer containing aqueous composition allows the initial adsorption of the polymer on the surface and the subsequent uptake of water from the atmosphere to be controlled by thermodynamics rather than to be controlled by the method of applying the composition. This approach is more precise than that of applying a macroscopic film, i.e., visible to the unaided eye, that gradually dissolves upon exposure to water or cleaning solutions. Macroscopic films that are uneven or not completely clear, due to the variations in consumer cleaning habits, change the appearance of cleaned surfaces in a manner less desirable than the present invention. It has been demonstrated that the uptake of water by the thin polymer gels is favored, spontaneous, and reversible.

A unique feature of the present invention is that many common surfaces, such as glass, metal and hydrophobic polymeric surfaces, such as plastics, that are treated with the inventive compositions release soil more easily when cleaned with a towel or sponge and water. This increase in the ease of "next time" cleaning is due to the increased amount of water on the surfaces, and the net decreased wetting of the surfaces by greasy soils.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular non-limiting embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, suitable materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the total composition.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule including, but not limited to linear, block, graft, random, alternating, branched and highly branched structures including comb, graft, starburst, dendrimers and dendrimeric structures thereof, and combinations thereof.

The terms "water soluble" and "water dispersible" as used herein, means that the polymer is soluble or dispersible in water in the inventive compositions. In general, the polymer should be soluble or dispersible at 25° C. at a concentration of 0.0001% by weight of the water solution and/or water carrier, preferably at 0.001%, more preferably at 0.01% and most preferably at 0.1%.

The term "cleaning composition", as used herein, is meant to mean and include a composition and/or formulation having at least one cleaning agent and/or cleaning aid.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

Hydroscopic polymer gels of the present invention are preferably developed from aqueous polymer containing compositions that are applied to a surface. The compositions can be formulated as cleaning compositions. Depending on the initial concentration of the polymer in the aqueous composition, water will either evaporate from the composition into the atmosphere or be sequestered into the composition from the ambient environment. The concentration of water will fluctuate with ambient conditions, such as temperature and relative humidity. As used herein, the term "polymer gel" refers to an aqueous mixture containing hydrophilic polymers that will adsorb to surfaces. The polymers can be water soluble or dispersible. No covalent bonds are needed to attach the polymers to the polymeric surface. The polymer gel may include other components as described herein.

In general, the aqueous polymer containing composition comprises a water soluble or water dispersible copolymer. The inventive hydroscopic copolymers are attracted to surfaces and are absorbed thereto without covalent bonds. Surprisingly, the hydroscopic copolymers of the present invention show high affinities to polymeric surfaces, including plastic and other polymeric substrates that are generally hydrophobic in nature, and thus are effective in modifying these materials to exhibit the beneficial properties, including easier cleaning, reduced soil adhesion and hydrophilic modification providing by treatment according to the methods described herein.

Copolymer

The inventive copolymer comprises a water soluble or water dispersible copolymer having at least one of (i) a first monomer that is acidic and that is capable of forming an anionic charge in the composition; and at least one of (ii) a second monomer that is amphipathic; and may optionally include (iii) a third monomer that is hydrophobic; and independently may further optionally include (iv) a fourth monomer that that has a permanent cationic charge or that is capable of forming a cationic charge on protonation.

With respect to the synthesis of the water soluble or water dispersible copolymer, the level of the first monomer, which is acidic and that is capable of forming an anionic charge in the composition, is typically between 0.05 and 90 mol % of the copolymer. The level of second monomer, which is amphiphatic is typically between 0.05 and 90 mol % of the copolymer. The mole ratio of the first monomer to the second monomer typically ranges from 19:1 to about 1:10. The level of the optional third monomer, which has an uncharged or neutral hydrophobic group, when present is typically between 0.05 and 50 mol % of the copolymer. When the third monomer is present, the mole ratio of the first monomer to the third monomer typically ranges from about 10:1 to 1:10. When present, the level of optional fourth monomer, which has a permanent cationic charge or is capable of forming a cationic charge on protonation is typically between 0.05 and 50 mol % of the copolymer. When the fourth monomer is present, the mole ratio of the first monomer to the fourth monomer typically ranges from about 10:1 to 1:10.

The average molecular weight of the copolymer typically ranges from about 5,000 to about 10,000,000, with the preferred molecular weight range depending on the polymer composition with the proviso that the molecular weight is selected so that the copolymer is water soluble or water dispersible to at least 0.01% by weight in distilled water at 25° C. In suitable non-limiting embodiments, the copolymer comprises from about 0.01 to 20% of the treatment and/or cleaning composition.

Acidic Monomer

Examples of acidic monomers that are capable of forming an anionic charge in the composition include, but are not limited to, acrylic acid, methacrylic acid, ethacrylic acid, laurylacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxy-propionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Other suitable acid monomers also include styrenesulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. The copolymers useful in this invention may contain the above acidic monomers and the alkali metal, alkaline earth metal, and ammonium salts thereof. Other suitable acidic monomers include thus disclosed in U.S. Pat. No. 5,547,612 to Austin, et al., which is hereby incorporated by reference.

Amphipathic Monomer

The amphipathic monomer of the present invention comprises at least one hydrophobic moiety and at least one hydrophilic moiety, which together define the amphipathic moiety, and may further comprise either a linkage group and/or an interatomic bond to link the hydrophobic and hydrophilic moieties within the amphipathic monomer unit. The amphiphatic monomer unit which may further comprise a second linkage and/or tether group to tether the amphipathic moiety to a polymerizable moiety incorporated into the inventive copolymer backbone. Optionally, the linkage and tether groups may be part of either the hydrophobic moiety and/or the hydrophilic moiety, e.g. being an atomic center or molecular subunit capable of forming either an interatomic bond and/or inter moiety bond linking the hydrophobic moiety and the hydrophilic moiety with at least one or more covalent bonds (i.e. at least one or more of a sigma and/or pi bond), and/or capable of forming either an interatomic bond and/or inter moiety bond linking the amphipathic moiety and the polymerizable moiety incorporated into the copolymer backbone with a least one or more covalent bonds.

Without being bound by theory, it is believed that the combination of the hydrophilic and hydrophobic moieties within the amphipathic monomer enables improved surface substantivity to surfaces, particularly normally hydrophobic surfaces such as plastics and polymeric substrates that are not easily wetted with water and generally exhibit non-polar surface properties. Generally, incorporation of a hydrophobic moiety into a water soluble polymer would otherwise tend to decrease the water solubility of the resulting copolymer, and at high levels may decrease the ability of hydroscopic copolymer films to absorb and retain water. It is believed however, that in the present inventive copolymers comprising an amphipathic monomer that incorporates at least one hydrophilic moiety, the hydrophobic-lipophobic balance, which may readily be adjusted and/or selected by suitable control of the molar mass ratio of the hydrophilic and hydrophobic moieties, may be selected to enhance absorption onto more hydrophobic substrates while maintaining the beneficial properties of water solubility and water adsorption that enables polymer gel formation. Thus, surprisingly, the mole content of the hydrophobic moiety, when incorporated into the inventive copolymers within an amphipathic monomer, may be present at fairly high mole content, with respect to the total copolymer composition, and still enable hydroscopic polymer gel formation by the copolymer. The inventive polymer gels incorporating amphipathic monomers correspondingly exhibit enhanced adsorption and substantivity to treated surfaces, which further feature enhanced resistance to rinsing with water and aqueous solvents, but which owing to the hydrophilic nature of the polymer gel continue to exhibit excellent hydration characteristics and subsequent resistance to deposition of hydrophobic soils such as soap scum and oil.

Suitable amphipathic monomers include those monomers having the general formula (I):

$$[A]_nB(C)_mLW \quad \text{I}$$

A being a hydrophobic radical having n total number of carbon atoms;

n being greater than 4 to about 100; wherein A comprises a branched hydrocarbon radical subunit selected from the group consisting an alkyl, alkylene, aryl, alkylaryl, benzyl, phenyl, polycyclic aromatic hydrocarbons, and/or derivatives thereof; B being an interatomic bond or a linkage group selected from —O—, —S—, —C(O)—, —C(O)C(O)—, —C(O)$CH_2$C(O)—, —NR1C(O)—, —C(O)O—, —OC(O)—, —C(O)O(CH2)$_p$— and —($CH_2$)$_p$—; p being from 1 to 6; (C)$_m$ comprising a hydrophilic moiety selected from —NH—, —SH—, —C(O)O—, —OC(O)—, —C(O)O(CH2)$_p$— and —O—[(CR1R2)$_i$—O]$_j$—; m being from 1 to 5; i being from 1 to 3; j being from 1 to about 50; L being a tether group selected from —C(O)—, —C(O)C(O)—, —C(O)$CH_2$C(O)—, —NR1C(O)—, —C(O)O—, —OC(O)—, —C(O)O(CH2)$_p$— and —(CH2)$_p$—; W being a polymerizable alkylene group selected from —(R1C═CR2)— and (R1R2C═CR3)—; R1, R2, R3 being independently selected from —H, —$CH_3$ and —($CH_2$)$_k$—, —X, phenyl; k being from 1 to about 6; X being selected from Cl, F, Br and I; wherein the ratio of the molar mass of A to molar mass of C is between 10:1 and 1:10. Suitable structures of the amphiphatic monomers of the present invention corresponding to formula I hereinabove, include all suitable isomers, structural configurations, and geometries possible for combining the specified radicals, linkage and tether groups.

Hydrophobic Radical (A)

The hydrophobic radical may be any branched hydrocarbon radical subunit selected from the group consisting an alkyl, alkylene, aryl, alkylaryl, benzyl and/or phenyl derivatives, and combinations thereof having a least one secondary carbon entity and/or at least one carbocyclic unit. Without being bound by theory, it is believed that the presence of a non-linear hydrophobic hydrocarbon group as the hydrophobic radical provides a highly localized and non-aggregating hydrophobic domain to the inventive copolymers which enhances their ability to deposit onto and remain substantive to surfaces, particularly more hydrophobic surfaces such as plastics and polymeric substrates. The presence of non-linear hydrophobic hydrocarbon groups are less prone to aggregation, such as that exhibited by linear long-chain alkyl groups commonly employed in surfactants and tenside systems in the art known to aggregate into condensed micellar phases. By employing hydrocarbon radicals having at least one secondary carbon entity and/or at least one carbocyclic unit, it is believed that a compact, a highly hydrophobic domain is obtained in the inventive copolymers that is less prone to aggregation and/or precipitation owing to polymer-polymer interactions and/or interactions with other hydrophobic materials present in the inventive compositions, such as surfactant. Without being bound by theory, the compact, highly hydrophobic moieties of the inventive copolymers are believed to be much more resistant to self-association and/or polymer-polymer aggregation, owing to the presence of at least one secondary carbon entity and/or at least one carbocyclic unit which acts to disrupt or prevent local packing and ordering of the hydrophobic hydrocarbon moieties both in solution and when deposited onto a treated surface.

Further, because the branched and/or cyclic hydrophobic moiety is less prone to aggregation, it is believed that it is more readily counterbalanced by the hydrophilic C moiety in achieving an overall favorable hydrophobic-lipophobic balance (HLB) or solubility value for the amphiphatic moiety that provides for the unique combination of water solubility and/or water dispersibility of the inventive copolymers, particularly in non-limiting embodiments of the inventive copolymers employing relatively high amphiphatic monomer content, while maintaining the two desirable properties of improved substantivity to surfaces, particularly hydrophobic surfaces, and the ability to form water rich hydroscopic polymer gels on the surfaces.

Accordingly, the hydrophobic radical (A) may be selected from any branched hydrocarbon radical subunit having a general structure selected from:

II

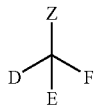

III

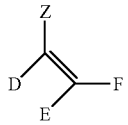

IV

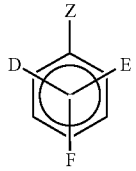

and

V

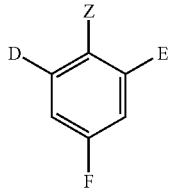

wherein Z=B, as defined hereinabove; D, E, F are radicals independently selected from single atomic substituents including hydrogen, fluorine, chlorine, and bromine, and radicals selected from alkyl, alkylene, aryl, arylalkyl, benzyl, phenyl, and combinations thereof, wherein if any one of D, E, and F is not a single atomic substituent, then D, E, and F independently are groups having between 1 to 50 carbon atoms. In structure IV, the D, E, and F substituents may independently occupy any combination of attachment sites at the ring carbons, in any order with respect to the Z ring attachment position including ortho, meta and para according to International Union of Pure and Applied Chemistry (I.U.P.A.C) nomenclature convention.

In addition, the hydrophobic radical (A) may be selected from dendritic and repeating subpolymer hydrocarbon radicals corresponding to the general formula (VI):

VI

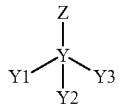

wherein Y is a single dendritic initiator ("core" group) subunit with at least two of Y1, Y2 and/or Y3 being first generation ("branch" groups) dendritic units and/or termination units ("surface" groups); wherein Y is a multivalent group selected from carbon, nitrogen, sulfur, phosphorous, alkyl, alkylene, aryl, arylalkyl, benzyl, phenyl, and/or derivatives thereof; wherein Y1, Y2 and/Y3 are radicals corresponding to the general formula (VII):

VII

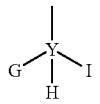

wherein G, H, I are independently selected from D, E, and F, as defined hereinabove, if being termination units; or may alternatively be independently selected from Y1, Y2 and/or Y3 if being second or higher generation dendritic branch units.

One example of a dendritic embodiment includes, but is not limited to the following structure (VIII):

VIII

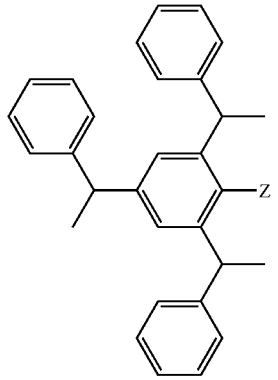

wherein the dendritic core corresponds to structure V hereinabove, with a single generation branching wherein D, E and F are terminating groups of structure (IX).

IX

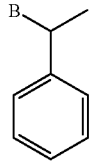

wherein B represents an interatomic bond in structure (IX).

Another example of a dendritic embodiment includes, but is not limited to the following structure (X):

X

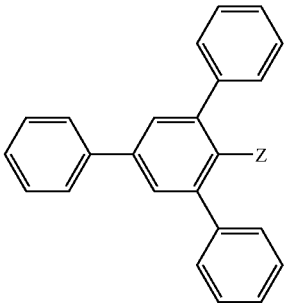

wherein the dendritic core corresponds to structure V hereinabove, with a single generation branching; wherein D, E and F are each a benzene radical termination ("surface") group.

It is noted that the dendritic and repeating subpolymer hydrocarbon radicals according to the present invention are described herein with respect to their structures, which may be obtained by any suitable synthetic means known to the art, including via synthetic and polymerization means commonly used to produce branched, dendritic, oligomeric, and/or block polymer derivatives, via derivatized aromatic substituted radicals, as well as step-wise sequential polymerization means.

Alternatively, the hydrophobic radical (A) may be selected from the known polycyclic aromatic hydrocarbon structures disclosed in "Polycyclic Aromatic Hydrocarbon Structure Index", NIST Special Publication 922, Authors: Lane C. Sander and Stephen A. Wise, Chemical Science and Technology Laboratory, National Institute of Standards and Technology (NIST), Gaithersburg, Md., which is hereby incorporated by reference. Suitable hydrophobic radicals include the referenced polycyclic aromatic hydrocarbon structures and additionally include dehydrogenated derivatives obtained through partial and/or complete hydrogenation of one or more aromatic and non-aromatic carbon-carbon double bonds thereof, derivatives thereof and linkage group adducts thereof, wherein substitution, derivation and/or dehydrogenation may be performed at any one or more positions on any one or more cyclic moieties of the polycyclic structures. Suitable aromatic polycyclic structures, including derivatives and chemical modifications thereof, include for example, but are not limited to aceanthrylene, acenaphth[1,2-a]anthracene, acenaphth[1,2-b]anthracene, acenaphthalene, acenaphthene, acenaphtho[1,2,3-cde]pyrene, acenaphtho[1,2-b]phenanthrene, acenaphtho[1,2-j]fluoranthene, acenaphtho[1,2-k]cyclopenta[cd]fluoranthene, acenaphtho[1,2-k]fluoranthene, 13H-acenaphtho[1,8-ab]phenanthrene, acenaphthylene, aceperylene, acephenanthrene, acepyrene, acepyrylene, [6]annulene, anthanthrene, anthra[1,2,3,4-rst]pentaphene, anthra[1,2-a]aceanthrylene, anthra[1,2-a]anthracene, anthra[1,2-a]benz[j]anthracene, anthra[1,2-a]naphthacene, anthra[1,2-b]phenanthren, anthra[1,9,8-abcd]benzo[hi]coronene, anthra[2,1,9,8,7-defghi]benzo[op]pentacene, anthra[2,1,9,8,7-defghi]benzo[st]pentacene, anthra[2,1,9,8,7-defghi]benzo[uv]pentacene, anthra[2,1,9,8-defgh]benzo[rst]pentaphene, anthra[2,1,9,8-defgh]pentaphene, anthra[2,1,9,8-opqra]naphthacene, anthra[2,1,9,8-stuva]pentacene, anthra[2,1,9-qra]naphthacene, anthra[2,1-a]aceanthrylene, anthra[2,1-a]naphthacene, anthra[2,3-a]coronene, anthra[2,3-a]naphthacene, anthra[3,2,1,9,8-rstuva]benzo[ij]pentaphene, anthra[3,2,1,9-pqra]benzo[cd]perylene, anthra[7,8,9,1,2,3-rstuvwx]hexaphene, anthra[8,9,1,2-cdefg]benzo[a]naphthacene, anthra[8,9,1,2-lmnop]benzo[a]naphthacene, anthra[9,1,2-abc]coronene, anthra[9,1,2-bcd]perylene, anthra[9,1,2-cde]benzo[rst]pentaphene, anthra[9,1-bc]fluorene, anthracene, anthraceno-1',2',1,2-anthracene, anthraceno[2,1-a]anthracene, anthracin, anthrodianthrene, 4,5-benz-10,11-(1',2'-naphtha)chrysene, benz[4,10]anthra[1,9,8-abcd]coronene, 15H-benz[4,5]indeno[1,2-l]phenanthrene, 9H-benz[4,5]indeno[2,1-c]phenanthrene, 7H-benz[5,6]indeno[1,2-a]phenanthrene, benz[5,6]indeno[2,1-a]phenalene, 7H-benz[5,6]indeno[2,1-a]phenanthrene, 9H-benz[5,6]indeno[2,1-c]phenanthrene, benz[a]aceanthrylene, benz[a]acenaphthylene, benz[a]acephenanthrylene, 1,2:5,6-benz[a]anthracene, benz[a]anthracene, benz[a]indeno[1,2-c]fluorene, benz[a]indeno[2,1-c]naphthalene, benz[a]indeno[5,6-g]fluorene, benz[a]ovalene, benz[b]anthracene, benz[b]indeno[2,1-h]fluorene, 11H-benz[bc]aceanthrylene, benz[c]indeno[2,1-a]fluorene, benz[d]aceanthrylene, benz[d]ovalene, 1H-benz[de]anthracene, benz[de]indeno[2,1-b]anthracene, benz[def]indeno[1,2,3-hi]chrysene, benz[def]indeno[1,2,3-qr]chrysene, benz[e]aceanthrylene, 3,4-benz[e]acephenanthrylene, benz[e]acephenanthrylene, 3H-benz[e]indene, 1H-benz[e]indene, 1H-benz[f]indene, 1H-benz[fg]aceanthrylene, 5H-benz[fg]acenaphthylene, 10H-benz[g]indeno[2,1-a]phenanthrene, benz[j]aceanthrylene, benz[j]acephenanthrylene, benz[k]acephenanthrylene, benz[l]aceanthrylene, benz[l]acephenanthrylene, benz[mno]aceanthrylene, benz[mno]indeno[1,7,6,5-cdef]chrysene, benz[mno]indeno[5,6,7,1-defg]chrysene, 2,3-benzanthracene, 1,2:5,6-benzanthracene, 1,2-benzanthracene, 1,2-benzanthrene, 1H-meso-benzanthrene, benzanthrene, benzanthreno-bz-1, Bz-2:2,3-naphthalene, benzene, 9,10[1',2']-benzenoanthracene, 9,10-dihydro-7,8-benzfluoranthene, 2,3-benzidene, benzine, 1,10-(peri)-benzo-1,5-dihydropyrene, 2,3-benzo-6,7-naphthoanthracene, benzo[1,2-a,3,4-a',5,6-a"]triacenaphthylene, benzo[1,2-a,4,5-a']diacenaphthylene, benzo[2,1--a:3,4-a']dianthracene, benzo[3,4]phenanthro[2,1,10,9,8,7-pqrstuv]pentaphene, benzo[6,7]-phenanthro[4,3-b]chrysene, benzo[a]anthanthrene, benzo[a]coronene, 1H-benzo[a]-cyclopent[h]anthracene, 9H-benzo[a]cyclopent[i]anthracene, benzo[a]cyclopenta[de]-naphthacene, benzo[a]cyclopenta[fg]naphthacene, benzo[a]cyclopenta[hi]-naphthacene, benzo[a]cyclopenta[mn]naphthacene, benzo[a]cyclopenta[op]-naphthacene, benzo[a]fluoranthene, 11H-benzo[a]fluorene, benzo[a]fluorene, benzo[a]heptacene, benzo[a]hexacene, benzo[a]hexaphene, benzo[a]naphth[2,1-j]anthracene, benzo[a]naphthacene, benzo[a]naphtho[1,2,3,4-ghi]perylene, benzo[a]naphtho[1,2-c]naphthacene, benzo[a]naphtho[1,2-h]anthracene, benzo[a]naphtho[1,2-j]naphthacene, benzo[a]naphtho[1,2-1]naphthacene, benzo[a]naphtho[2,1,8-cde]perylene, benzo[a]naphtho[2,1,8-hij]naphthacene, benzo[a]naphtho[2,1,8-lmn]perylene, benzo[a]naphtho[2,1-h]pyrene, benzo[a]naphtho[2,1-j]naphthacene, benzo[a]naphtho[2,1-1]naphthacene, benzo[a]naphtho[7,8,1,2,3-pqrst]pentaphene, benzo[a]naphtho[8,1,2-cde]naphthacene, benzo[a]naphtho[8,1,2-klm]perylene, benzo[a]naphtho[8,1,2-lnm]naphthacene, benzo[a]pentacene, benzo[a]pentaphene, benzo[a]perylene, benzo[a]-phenanthrene, benzo[a]picene, benzo[a]pyranthrene, benzo[a]pyrene, benzo[b]anthanthrene, benzo[b]chrysene, 5H-benzo[b]cyclopenta[def]chrysene, 13H-benzo[b]cyclopenta[def]triphenylene, benzo[b]cyclopenta[hi]chrysene, 4H-benzo[b]cyclopenta[jkl]triphenylene, 4H-benzo[b]cyclopenta[mno]chrysene, benzo[b]cyclopenta[qr]chrysene, benzo[b]fluoranthene, 11H-benzo[b]fluorene, benzo[b]naphthacene, benzo[b]naphtho[1,2,3,4-pqr]perylene, benzo[b]naphtho[1,2-k]chrysene, benzo[b]naphtho[1,2-l]chrysene, benzo[b]naphtho[2,1-g]chrysene, benzo[b]naphtho[2,1-k]chrysene, benzo[b]naphtho[2,1-p]chrysene, benzo[b]-naphtho[2,3-g]chrysene, benzo[b]naphtho[2,3-j]chrysene, benzo[b]naphtho[2,3-l]chrysene, benzo[b]naphtho[8,1,2-pqr]chrysene, benzo[b]pentahelicene, benzo[b]pentaphene, benzo[b]perylene, benzo[b]phenanthrene, benzo[b]picene, benzo[b]triphenylene, benzo[bc]naphtho[1,2,3-ef]coronene, benzo[bc]naphtho[3,2,1-ef]coronene, benzo[c]chrysene, benzo[c]cyclopenta[hi]chrysene, 4H-benzo[c]-cyclopenta[mno]chrysene, benzo[c]cyclopenta[qr]chrysene, benzo[c]-luorene, 7H-benzo [c]fluorene, benzo[c]hexaphene, benzo[c]naphtho[1,2-l]chrysene, benzo[c]naphtha[2,1-m]pentaphene, benzo[c]naphtho[2,1-p]chrysene, benzo[c]naphtho[2,3-l]chrysene, benzo[c]naphtho[7,8,1,2,3-pqrst]pentaphene, benzo[c]naphtho[8,1,2-ghi]chrysene, benzo[c]pentahelicene, benzo[c]pentaphene, benzo[c]phenanthrene, benzo[c]picene, benzo[c]tetraphene, 1H-benzo[cd]-fluoranthene, benzo[cd]naphtho[3,2,1,8-pqra]perylene, 6H-benzo[cd]pyrene, 3H-benzo[cd]pyrene, 5H-benzo[cd]pyrene, 2H-benzo[cd]pyrene, benzo[de]cyclopent-[a]anthracene, benzo[de]cyclopent[b]anthracene, benzo[de]naphtho[2,1,8,7-qrst]pentacene, benzo[de]naphtho[3,2,1-mn]naphthacene, benzo[de]naphtho[8,1,2,3-stuv]picene, 7H-benzo[de]pentacene, benzo[def]chrysene, benzo[def]cyclopenta-[hi]chrysene, 4H-benzo[def]cyclopenta[mno]chrysene, benzo[def]cyclopenta[qr]-chrysene, benzo[def]fluorene, benzo[def]phenanthrene, benzo[def]pyranthrene, benzo[e]anthanthrene, benzo[e]cyclopenta[jk]pyrene, benzo[e]cyclopenta[jk]pyrene, benzo[e]fluoranthene, benzo[e]phenanthro[1,10,9,8-opqra]perylene, benzo[e]-phenanthro[2,3,4,5-pqrab]perylene, benzo[e]pyrene, benzo[ef]phenaleno-[9,1,2-abc]coronene, benzo[f]pentahelicene, benzo[f]picene, benzo[fg]cyclopent[a]-anthracene, benzo[fg]naphtho[1,2,3-op]naphthacene, benzo[g]chrysene, 8H-benzo[g]cyclopenta[mno]chysene, benzo[g]naphtho[2,1-b]chrysene, benzo[g]naphtho[8,1,2-abc]coronene, benzo[ghi]cyclopenta[cd]perylene, 1H-benzo [ghi]cyclopenta[pqr]perylene,benzo[ghi]fluoranthene, benzo[ghi]naphtho[2,1-a]perylene, benzo[ghi]naphtho[2,1-b]perylene, benzo[ghi]perylene, benzo[h]naphtho[1,2,3,4-rst]pentaphene, benzo[h]naphtho[7,8,1,2,3-pqrst]pentaphene, benzo[h]pentaphene, benzo[h]phenanthro[2,1,10,9,8,7-pqrstuv]pentaphene, 7H-benzo[hi]chrysene, 4H-benzo[hi]chrysene, benzo[i]-pentahelicene, benzo[ij]naphtho[2,1,8,7-defg]pentaphene, benzo[j]benzo[2,1-a:3,4-a']dianthracene, benzo[j]fluoranthene, benzo[j]naphtho[8,1,2-abc]coronene, benzo[jk]fluorene, benzo[k]fluoranthene, benzo[kl]naphtho[2,1,8,7-defg]pentaphene, benzo[l]cyclopenta[cd]pyrene, benzo[l]fluoranthene, benzo[l]naphtho[1,2-b]chrysene, benzo[l]naphtho[2,1-b]chrysene, benzo[l]phenanthrene, benzo[lm]naphtho[1,8-ab]perylene, benzo[lm]phenanthro[5,4,3-abcd]perylene, benzo[lmn]naphtho[2,1,8-qra]perylene, benzo[m]naphtho[8,1,2-abc]coronene, benzo[mno]fluoranthene, benzo[mno]naphtho[1,2-c]chrysene, benzo[mno]naphtho[2,1-c]chrysene, benzo[o]-hexaphene, 8H-benzo[p]cyclopenta[def]chrysene, benzo[p]hexaphene, benzo[p]-naphtho[1,2-b]chrysene, benzo[p]naphtho[1,8,7-ghi]chrysene, benzo[p]naphtho[2,1-b]chrysene, benzo[p]naphtho[8,1,2-abc]coronene, benzo[pqr]dinaphtho[8,1,2-bcd:2',1',8'-lmn]perylene, benzo[pqr]naphtho[1,2-b]perylene, benzo[pqr]naphtha-[2,1,8-def]picene, benzo[pqr]naphtho[2,1-b]perylene, benzo[pqr]naphtho[8,1,2-bcd]perylene, benzo[pqr]naphtho[8,1,2-cde]picene, benzo[pqr]picene, benzo[q]hexa-phene, benzo[qr]naphtho[2,1,8,7-defg]pentacene, benzo[qr]naphtho[2,1,8,7-fghi]pentacene, benzo[qr]naphtho[3,2,1,8-defg]chrysene, benzo[qrs]naphtha-[3,2,1,8,7-defgh]pyranthrene, benzo[rst]dinaphtho[8,1,2-cde:2',1',8'- klm]pentaphene, benzo[rst]naphtho[2,1,8-fgh]pentaphene, benzo[rst]naphtho[8,1,2-cde]pentaphene, benzo[rst]pentaphene, benzo[rst]phenanthro[1,10,9-cde]pentaphene, benzo[rst]-phenanthro[10,1,2-cde]pentaphene, benzo[rst]pyreno[1,10,9-cde]pentaphene, benzo[s]picene, benzo[st]naphtho[2,1,8,7-defg]pentacene, benzo[tuv]naphtho[2,1-b]picene, benzo[uv]naphtho[2,1,8,7-defg]pentacene, benzo[uv]naphtho[2,1,8,7-defg]pentaphene, benzo[vwx]hexaphene, 1,2-benzoacenaphthylene, benzobenzanthrene, 2,3-benzochrysene, 15,16-benzodehydrocholanthrene, o-meso-benzodianthrene, p-meso-benzodianthrene, 11,12-benzofluoranthene, 2,13-benzofluoranthene, benzofluoranthene, 7,10-benzofluoranthene, 8,9-benzofluoranthene, 10,11-benzo-fluoranthene, 3,4-benzofluoranthene, 2,3-benzofluoranthene, 1,2-benzofluorene, 2,3-benzofluorene, 3,4-benzofluorene, benzol, 1H-benzonaphthene, 1,12-benzoperylene, 1,2-benzoperylene, 2,3-benzoperylene, 1,2-benzophenanthrene, 2,3-benzophen-anthrene, 3,4-benzophenanthrene, 9,10-benzophenanthrene, 2,3-benzopicene, 6,7-benzopyrene, 3,4-benzopyrene, 3,4-benzotetraphene, 1,2-benzperylene, 1,2-benzpyrene, 4,5-benzpyrene, 2,3-benztriphenylene, 2,3:1',8'-binaphthylene, 3,4-(o,o'-biphenylene)cyclopentadiene, 3,4-(o,o'-biphenylene)fluorene, o-biphenylenemethane, biphenylenephenanthrene, o-biphenylmethane, bisanthrene, ceranthrene, homeo-cerodianthrene, cholanthrene, cholanthrylene, chrysene, chryseno[2,1-b]picene, chrysofluorene, corannulene, coronene, 1,2-cyclo-delta 1',3'-pentadienophenanthrene, 1,2-cyclo-delta 1',4'-pentadienophenanthrene, cyclohexatriene, 1H-cyclopent[a]-anthracene, 1H-cyclopent [b]anthracene, cyclopent[b]indeno[4,5-g]phenanthrene, cyclopent[b]indeno[5,6-g]phenanthrene, cyclopent[i]indeno[5,6-a]anthracene, 17H-cyclopenta[a]phenanthrene, 15H-cyclopenta[a]phenanthrene, 1H-cyclopenta[a]pyrene, 11H-cyclopenta[a]triphenylene, 8H-cyclopenta[b]phenanthrene, cyclopenta[cd]-perylene, cyclopenta[cd]pyrene, cyclopenta[de]anthracene, cyclopenta[de]-naphthacene, cyclopenta[de]naphthalene, cyclopenta[de]pentacene, cyclopenta[de]-pentaphene, cyclopenta[de]picene, 4H-cyclopenta[def]chrysene, 4H-cyclopenta[def]-phenanthrene, 4H-cyclopenta[def]triphenylene, 1H-cyclopenta[e]pyrene, cyclopenta[fg]naphthacene, cyclopenta[fg]pentacene, cyclopenta[fg]pentaphene, 11H-cyclopenta[ghi]perylene, 6H-cyclopenta[ghi]picene, cyclopenta[hi]chrysene, cyclopenta[jk]phenanthrene, 1H-cyclopenta[l]phenanthrene, 2H-cyclopenta[l]phenanthrene, cyclopenta[pq]pentaphene, 13H-cyclopenta[pqr]picene, 13H-cyclopenta[rst]pentaphene, cyclopentaphenanthrene, decayclene, dehydro-8,9-trimethylene-1,2-benzanthracene, 3,4,1,6-di(1,8-naphthylene)benzene, 1,9,5,10-di(peri-naphthylene)anthracene, di-beta-naphthofluorene, dibenz[a,c]anthracene, dibenz[a,e]aceanthrylene, dibenz[a,e]acephenanthrylene, dibenz[a,h]anthracene, dibenz[a,j]aceanthrylene, dibenz[aj]anthracene, dibenz[a,k]acephenanthrylene, 7H-dibenz[a,kl]anthracene, 1H-dibenz[a,kl]anthracene, 4H-dibenz[a,kl]anthracene, dibenz[a,l]aceanthrylene, dibenz[a,n]triphenylene, 13H-dibenz[bc,j]aceanthrylene, 13H-dibenz[bc,l]aceanthrylene, dibenz[de,kl]anthracene, dibenz[e,ghi]indeno[1,2,3,4-pqra]perylene, dibenz[e,j]aceanthrylene, dibenz[e,k]acephenanthrylene, dibenz[e,l]aceanthrylene, dibenz[e,l]acephenanthrylene, 1,2:3,4-dibenzanthracene, 3,4,5,6-dibenzanthracene, 2,3:6,7-dibenzanthracene, 1,2,7,8-dibenzanthracene, beta,beta'-dibenzanthracene, 1,2,6,7-dibenzanthracene, 1,2,3,4-dibenznaphthalene, dibenzo-1,2,7,8-anthracene, dibenzo-2,3,11,12-fluoranthene, 1,2,7,8-dibenzo-4,5-phenanthrylenemethane, dibenzo[a,c]chrysene, 13H-dibenzo[a,c]fluorene, dibenzo[a,c]naphthacene, dibenzo[a,c]pentacene, dibenzo[a,c]pentaphene, dibenzo[a,c]picene, dibenzo[a,c]tetraphene, dibenzo[a,c]triphenylene, dibenzo[a,cd]-naphtho[8,1,2,3-fghi]perylene, dibenzo[a,d]coronene, 13H-dibenzo[a,de]naphth[2,3-h]anthracene, 4H-dibenzo[a,de]naphthacene, 4H-dibenzo[a,de]pentacene, dibenzo[a,e]fluoranthene, dibenzo[a,e]pyrene, dibenzo[a,f]fluoranthene, dibenzo[a,f]-perylene, dibenzo[a,f]picene, dibenzo[a,f]-tetraphene, dibenzo[a,g]coronene, 13H-dibenzo[a,g]fluorene, dibenzo[a,ghi]naphtho[2,1,8-cde]perylene, dibenzo[a,ghi]-naphtha[2,1,8-lmn]perylene, dibenzo[a,ghi]naphtho[8,1,2-klm]perylene, dibenzo[a,ghi]perylene, 13H-dibenzo[a,h]fluorene, dibenzo[a,h]pentaphene, dibenzo[a,h]phenanthrene, dibenzo[a,h]pyrene, 13H-dibenzo[a,i]fluorene, dibenzo[a,i]pyrene, dibenzo[a,j]coronene, dibenzo[a,j]fluoranthene, dibenzo[a,j]-naphthacene, dibenzo[a,j]perylene, dibenzo[a,j]plcene, dibenzo[a,j]tetracene, dibenzo[a,jk]fluorene, dibenzo[a,k]fluoranthene, dibenzo[a,k]tetraphene, dibenzo[a,l]fluoranthene, dibenzo[a,l]naphthacene, dibenzo[a,l]pentacene, dibenzo[a,l]pyrene, dibenzo[a,m]pentaphene, dibenzo[a,m]tetraphene, dibenzo[a,n]-pentacene, dibenzo[a,n]perylene, dibenzo[a,n]picene, dibenzo[a,o]pentaphene, dibenzo[a,o]perylene, dibenzo[a,o]picene, dibenzo[a,p]chrysene, dibenzo[a,pqr]-picene, dibenzo[a,rst]naphtho[8,1,2-cde]pentaphene, dibenzo[a,rst]pentaphene, dibenzo[b,def]chrysene, dibenzo[b,e]fluoranthene, dibenzo[b,f]picene, 8H-dibenzo[b,fg]pyrene, dibenzo[b,g]chrysene, 7H-dibenzo[b,g]fluorene, dibenzo[b,g]phenanthrene, dibenzo[b,ghi]fluoranthene, dibenzo[b,ghi]perylene, 12H-dibenzo[b,h]fluorene, dibenzo[b,h]phenanthrene, dibenzo[b,h]pyrene, dibenzo[bj]-fluoranthene, dibenzo[bj]plcene, dibenzo[b,jk]fluorene, dibenzo[b,k]-chrysene, dibenzo[b,k]fluoranthene, dibenzo[b,k]perylene, dibenzo[b,l]chrysene, dibenzo[b,l]-fluoranthene, dibenzo[b,m]picene 8H-dibenzo[b,mn]phenanthrene 13H-dibenzo-[b,mn]phenanthrene, dibenzo[b,mno]-fluoranthene, dibenzo[b,n]pentaphene, dibenzo[b,n]perylene, dibenzo[b,n]picene, dibenzo[b,p]chrysene, dibenzo[b,pqr]-perylene, dibenzo[b,qr]naphtho[3,2,1,8-defg]chrysene, dibenzo[b,s]picene, dibenzo[b,tuv]naphtho[2,1-m]picene, dibenzo[b,tuv]picene, dibenzo[bc,ef]coronene, dibenzo[bc,kl]coronene, dibenzo[c,f]tetraphene, dibenzo[c,g]chrysene, 7H-dibenzo[c,g]fluorene, dibenzo[c,g]phenanthrene, dibenzo[c,h]pentaphene, dibenzo[c,hi]naphtho[3,2,1,8-mnop]chrysene, dibenzo[c,i]cyclopenta[a]fluorene, dibenzo[c,k]tetraphene, dibenzo[c,l]chrysene, dibenzo[c,lm]fluorene, dibenzo[c,m]pentaphene, dibenzo[c,m]picene, dibenzo[c,m]tetraphene, 5H-dibenzo[c,mn]phenanthrene, dibenzo[c,mno]chrysene, dibenzo[c,p]chrysene, dibenzo[c,pqr]picene, dibenzo[c,rst]pentaphene, dibenzo[c,s]picene, dibenzo[cd,fg]-anthanthrene, dibenzo[cd,hi]anthanthrene, dibenzo[cd,jk]pyrene, dibenzo[cd,k]-naphtha[3,2,1,8-pqra]perylene, dibenzo[cd,lm]anthanthrene, dibenzo[cd,lm]perylene, dibenzo[cd,n]naphtho[3,2,1,8-pqra]perylene, dibenzo[de,ij]naphtho[3,2,1,8,7-rstuv]pentaphene, dibenzo[de,ij]naphtho[7,8,1,2,3-pqrst]pentaphene, dibenzo[de,ij]-pentaphene, dibenzo[de,kl]pentaphene, dibenzo[de,mn]naphthacene, dibenzo[de,mn]-naphtho[2,1,8-qra]naphthacene, dibenzo[de,op]naphthacene, dibenzo[de,qr]-naphthacene, dibenzo[de,qr]pentacene, dibenzo[de,qr]tetracene, dibenzo[de,st]pentacene, dibenzo[de,uv]pentacene, dibenzo[de,uv]pentaphene, dibenzo[def,mno]-chrysene, dibenzo[def,mno]cyclopenta[hi]chrysene, dibenzo[def,p]chrysene, dibenzo[e,ghi]perylene, dibenzo[e,l]pyrene, dibenzo[ef,hi]naphtho[8,1,2-abc]coronene, dibenzo[ef,no]naphtho[8,1,2-abc]coronene, dibenzo[fj]naphtha-[1,2,3,4-pqr]picene, dibenzo[fj]picene, dibenzo[f,m]

tetraphene, dibenzo[f,pqr]picene, dibenzo[f,s]picene, dibenzo[fg,ij]naphtho[2,1,8-uva]pentaphene, dibenzo[fg,ij]naphtha[7,8,1,2,3-pqrst]pentaphene, dibenzo[fg,ij]pentaphene, dibenzo[fg,ij]phenanthro[2,1,10,9,8,7-pqrstuv]pentaphene, dibenzo[fg,ij]phenanthro-[9,10,1,2,3-pqrst]pentaphene, dibenzo[fg,op]anthanthrene, dibenzo[fg,op]-naphthacene, dibenzo[fg,qr]pentacene, dibenzo[fg,st]hexacene, dibenzo[fgh,pqr]-trinaphthylene, dibenzo[g,p]chrysene, dibenzo[ghi,lm]naphtho[1,8-ab]perylene, dibenzo[ghi,nmo]fluoranthene, dibenzo[ghi,n]naphtho[8,1,2-bcd]perylene, dibenzo[ghi,pqr]perylene, dibenzo[h,rst]pentaphene, dibenzo[hi,kl]naphtho[8,1,2-abc]coronene, dibenzo[hi,qr]anthanthrene, dibenzo[ij,rst]naphtho[2,1,8,7-defg]pentaphene, dibenzo[ij,rst]phenanthro[9,10,1,2-defg]pentaphene, dibenzo[ijk,tuv]peropyrene, dibenzo[j,l]fluoranthene, dibenzo[j,lm]naphtho[1,8-ab]perylene, dibenzo[j,lm]phenanthro[5,4,3-abcd]perylene, dibenzo[kl,no]naphtha-[8,1,2-abc]coronene, dibenzo[kl,rst]naphtho[2,1,8,7-defg]pentaphene, dibenzo[mn,qr]fluoreno[2,1,9,8,7-defghi]naphthacene, dibenzo[pq,uv]pentaphene, dibenzo[q,vwx]hexaphene, dibenzo[rs,vwx]naphtho[2,1,8,7-klmn]hexaphene, 2,3,6,7-dibenzoanthracene, 1,2,5,6-dibenzoanthracene, 2,3,8,9-dibenzocoronene, 2,3,4,5-dibenzocoronene, vic-diperi-dibenzocoronene, anti-diperi-dibenzocoronene, 2,3,5,6-dibenzofluoranthene, 1,2,3,4-dibenzofluorene, 2,3,6,7-dibenzofluorene, 1,2,7,8-dibenzofluorene, 1,2,5,6-dibenzofluorene, 2,3,10,11-dibenzoperylene, 2,3,8,9-dibenzoperylene, 1.12,2.3-dibenzoperylene, 1.12,4.5-dibenzoperylene, 1,2,5,6-dibenzophenanthrene, 2,3:7,8-dibenzophenanthrene, beta,beta'-dibenzophenanthrene, 3,4,5,6-dibenzophenanthrene, gamma,gamma'-dibenzophenanthrene, 2,3,6,7-dibenzophenanthrene, 4,5,9,10-dibenzopyrene, 2,3:4,5-dibenzopyrene, 3,4:8,9-dibenzopyrene, 1,2:4,5-dibenzopyrene, 4,5,6,7-dibenzopyrene, 3,4:9,10-dibenzopyrene, 1,2:9,10-dibenzopyrene, 4,5,8,9-dibenzopyrene, 1.2,9.10-dibenzotetracene, 1.2,7.8-dibenzotetracene, 1.2,5.6-dibenzotetraphene, 1,2:7,8-dibenzphenanthrene, 3,4:8,9-dibenzpyrene, 1,2:3,4-dibenzpyrene, 1,2:7,8-dibenzpyrene, 1,2:6,7-dibenzpyrene, dicyclopenta[a,c]naphthacene, dicyclopenta[a,j]coronene, difluorenylene, 1,2-dihydroacenaphthylene, 1,2-dihydroben[j]aceanthrylene, 3,4-dihydrocyclopenta[cd]pyrene, 10,15-dihydrotribenzo[a,f,k]trindene, diindeno[1,2,3-cd: 1',d',3'-jk]pyrene, diindeno[1,2,3-de, 1',2',3'-kl]anthracene, dinaphth[1,2-a: 1',2'-h]anthracene, dinaphth[1,2-a:2',1'-j]anthracene, dinaphth[2,3-a,2',3'-c]anthracene, peri-dinaphthalene, lin-dinaphthanthracene, dinaphtho[1,2,3-cd, 1',2',3'-lm]perylene, dinaphtho[1,2,3-cd,3',2',1'-lm]perylene, dinaphtho[1,2,3-fg: 1',2',3'-qr]pentacene, dinaphtho[1,2,3-fg:3',2',1'-qr]pentacene, dinaphtho[1,2-b,2',1'-n]perylene, dinaphtho[1,2-b: 1',2'-k]chrysene, dinaphtho[1,8-ab: 8',1',2',3'-fghi]perylene, dinaphtho[1,8-bc: 1',8'-mn]picene, dinaphtho[2,1,8,7-defg: 2',1',8',7'-ijkl]pentaphene, dinaphtho[2,1,8,7-defg:2',1',8',7'-opqr]pentacene, dinaphtho[2,1,8,7-defg:2',1',8',7'-qrst]pentacene, dinaphtho[2,1,8-cde,2',1',8'-lmn]perylene, dinaphtho[2,1,8-fgh:3',2',1',8',7'-rstuv]pentaphene, dinaphtho[2,1,8-fgh:7',8',1',2',3'-pqrst]pentaphene, dinaphtho[2,1,8-jkl:2',1',8'-uva]pentacene, dinaphtho[2,1-a: 1',2'-l]naphthacene, dinaphtho[2,1-a:2',1'-j]naphthacene, dinaphtho[2,1-c 1',2'-g]phenanthrene, dinaphtho[2,3-c:2',3'-m]pentaphene, dinaphtho[3,2,1-fg: 1',2',3'-ij]pentaphene, dinaphtho[3,2,1-fg:3',2',1'-qr]pentacene, dinaphtho[8,1,2-abc:2',1',8'-efg]coronene, dinaphtho[8,1,2-abc:2',1',8'-hij]coronene, dinaphtho[8,1,2-abc:2',1',8'-klm]coronene, dinaphtho[8,1,2-abc:2',1',8'-nop]coronene, dinaphtho[8,1,2-abc: 8',1',2'-ghi]coronene, dinaphtho[8,1,2-abc:8',1',2'-jkl]coronene, dinaphtho[8,1,2-cde:7',8',1',2',3'-pqrst]pentaphene, dinaphtho[8,1,2-lmn:2',1',8'-qra]naphthacene, alpha,alpha'-dinaphthofluorene, diphenanthro[3,4-c:4',3'-g]phenanthrene, diphenylenemethane, 9,10-diphenylenephenanthrene, 2,3,3',2'-dipyrenylene, 1,8-ethylenenaphthalene, fluoranthene, fluorantheno[8,9-b]triphenylene 9H-fluorene, fluorene, fluoreno[2,1-a]fluorene, fluoreno[2,3-a]fluorene, fluoreno[3,2,1,9-defg]chrysene, fluoreno[3,2-b]fluorene, fluoreno[3,4-b]fluorene, fluoreno[4,3,2-de]anthracene, fluoreno[4,3-c]fluorene, fluoreno[9,1-ab]triphenylene, [6]helicene, heptacene, heptap,hene, hexabenzobenzene, hexacene, hexahelicene, hexaphene, idryl, as-indacene, s-indacene, as-indaceno[2,3-a]phenanthrene, 1H-indene, indene, indeno-2',3'-3,4-pyrene, indeno[1,2,3-cd]fluoranthene, indeno[1,2,3-cd]perylene, indeno[1,2,3-cd]pyrene, indeno[1,2,3-de]naphthacene, indeno[1,2,3-fg]naphthacene, indeno[1,2,3-hi]chrysene, 8H-indeno [1,2-a]anthracene, indeno[1,2-a]phenalene, 7H-indeno[1,2-a]phenanthrene, 7H-indeno[1,2-a]pyrene, 11H-indeno[1,2-a]triphenylene, 13H-indeno[1,2-b]anthracene, 12H-indeno[1,2-b]phenanthrene, 13H-indeno[1,2-c]phenanthrene, 9H-indeno[1,2-e]pyrene, 13H-indeno[1,2-l]phenanthrene, indeno[1,7,6,5-cdef]chrysene, indeno[1,7-ab]chrysene, indeno[1,7-ab]pyrene, indeno[1,7-ab]triphenylene, indeno[1,7a-a]phenanthrene, 3H-indeno[2,1,7-cde]pyrene, 11H-indeno[2,1,7-cde]pyrene, 13H-indeno[2,1,7-qra]naphthacene, 13H-indeno[2,1-a]anthracene, 5H-indeno [2,1-a]chrysene, indeno[2,1-a]phenalene, 11H-indeno[2,1-a]phenanthrene, 11H-indeno[2,1-a]pyrene, 8H-indeno[2,1-b]phenanthrene, 9H-indeno[2,1-c]phenanthrene, indeno[3,2,1,7-defg]chrysene, indeno[4,3,2,1-cdef]chrysene, indeno[5,6,7,1-defg]chrysene, indeno[5,6,7,1-pqra]perylene, indeno[6,7,1,2-defg]naphthacene, 1H-indeno[6,7,1-mna]anthracene, indeno[7,1,2,3-cdef]chrysene, 4H-indeno[7,1,2-ghi]chrysene, indeno[7,1-ab]naphthacene, indeno[7,1-ab]triphenylene, indeno[7,1-bc]chrysene, isochrysene, isochrysofluorene, isonaphthofluorene, 1',9-methylene-1,2,5,6-dibenzanthracene, 1',9-methylene-1,2-benzanthracene, 2,2'-methylenebiphenyl, 4,5-methylenephenanthrene, 1,9,8-(diperi)-naphth-2,9-dihydroanthracene, naphth[1',':5,6]indeno[1,2,3-cd]pyrene, naphth[1,2-a]aceanthrylene, naphth[1,2-a]acephenanthrylene, naphth[1,2-a]anthracene, naphth[1,2-d]acenaphthylene, naphth[1,2-e]acephenanthrylene, naphth[1,2-j]aceanthrylene, naphth[1,2-k]acephenanthrylene, naphth[2',1':4,5]indeno[1,2,3-cd]pyrene, naphth[2,1-a]aceanthrylene, naphth[2,1-a]anthracene, naphth[2,1-d]acenaphthylene, naphth[2,1-e]aceanthrylene, naphth[2,1-e]acephenanthrylene, naphth[2,1-k]acephenanthrylene, naphth[2,1-l]aceanthrylene, naphth[2,1-l]acephenanthrylene, naphth[2,3-a]aceanthrylene, naphth[2,3-e]acenaphthylene, naphth[2,3-e]acephenanthrylene, naphth[2,3-l]acephenanthrylene, 5H-naphth[3,2,1-de]anthrene, 2',1'-naphtha-1,2-fluorene, 1',2'-naphtha-2,3-fluorene, 1',3'-naphtha-3,4-pyrene, naphthacene, naphthaceno[2,1,12,11-opqra]naphthacene, naphthaceno[4,5,6,7,8-defghij]naphthacene, peri-naphthacenonaphthacene, naphthalene, 1,2-(1,8-naphthalenediyl)benzene, naphthalin, naphthanthracene, naphthanthracene, 8H-meso-alpha-naphthanthrene, 1,8,9-naphthanthrene, naphthanthrene, lin-naphthanthrene, 13H-meso-alpha-naphthanthrene, 1H-alpha-naphthindene, 1H-beta-naphthindene, 3H-alpha-naphthindene, naphtho(2',':7,8)fluoranthene, naphtho(2',':8,9)fluoranthene, naphtho-(2'3':4,5)pyrene, 1',2'-naphtho-1,2-fluoranthene, naphtho-2',3',1,2-anthracene, naphtho-2',3',1,2-phenanthrene, naphtho-2',3',2,3-phenanthrene, naphtho-2',3',3,4-phenanthrene, naphtho[1,2,3,4-def]chrysene, naphtho[1,2,3,4-ghi]fluoranthene, naphtho[1,2,3,4-ghi]perylene, naphtho[1,2,3,4-rst]pentaphene, 9H-naphtho[1,2,3-cd]perylene, 6H-naphtho[1,2,3-cd]pyrene, naphtho[1,2-a]coronene, naphtho[1,2-a]fluoranthene, naphtho[1,2-a]naphthacene, naphtho[1,2-a]pentacene, naphtho[1,2-a]pentaphene, naphtho[1,2-a]pyrene, naphtho[1,2-a]tetracene, naphtho[1,2-a]tetraphene, naphtho[1,2-b]chrysene, naphtho[1,2-b]fluoranthene, 12H-naphtho[1,2-b]fluorene, naphtho[1,2-b]perylene, naphtho[1,2-b]picene, naphtho[1,2-b]triphenylene, naphtho[1,2-c]chrysene, naphtho[1,2-c]pentaphene, naphtho[1,2-e]pyrene, naphtho[1,2-f]picene, naphtho[1,2-g]chrysene, naphtho[1,2-h]pentaphene, naphtho[1,2-j]fluoranthene, naphtho[1,2-k]fluoranthene, naphtho[1,8,7,6-cdef]fluorene, naphtho[2',':2,3]fluoranthene, naphtho[2'.1',1.2]tetracene, naphtho[2'.3',1.2]pyrene, naphtho[2,1,8-def]picene, naphtho[2,1,8-fgh]pentaphene, naphtho[2,1,8-hij]anthanthrene, naphtho[2,1,8-qra]naphthacene, naphtho[2,1,8-uva]pentacene, naphtho[2,1,8-uva]pentaphene, naphtho[2,1,8-yza]hexacene, naphtho[2,1-a]fluoranthene, 11H-naphtho[2,1-a]fluorene, naphtho[2,1-a]naphthacene, naphtho[2,1-a]pentaphene, naphtho[2,1-a]picene, naphtho[2,1-a]pyrene, naphtho[2,1-a]tetraphene, naphtho[2,1-b]chrysene, naphtho[2,1-b]fluoranthene, naphtho[2,1-b]perylene, naphtho[2,1-b]picene, naphtho[2,1-c:7,8-c']diphenanthrene, naphtho[2,1-c]chrysene, naphtho[2,1-c]pentaphene, naphtho[2,1-c]picene, naphtho[2,1-c]tetraphene, naphtho[2,1-j]fluoranthene, naphtho[2,3-a]coronene, naphtho[2,3-a]fluoranthene, 13H-naphtho[2,3-a]fluorene, naphtho[2,3-a]pentaphene, naphtho[2,3-a]picene, naphtho[2,3-a]pyrene, naphtho[2,3-a]tetraphene, naphtho[2,3-b]fluoranthene, naphtho[2,3-b]picene, naphtho[2,3-b]pyrene, naphtho[2,3-c]chrysene, 8H-naphtho[2,3-c]fluorene, naphtho[2,3-c]pentaphene, naphtho[2,3-e]pyrene, naphtho[2,3-g]chrysene, naphtho[2,3-h]pentaphene, naphtho[2,3-j]fluoranthene, naphtho[2,3-k]fluoranthene, naphtho[2,3-s]picene, naphtho[3',':3,4]pyrene, naphtho[3,2,1,8,7-defgh]pyranthrene, naphtho[3,2,1,8,7-vwxyz]hexaphene, naphtho[3,2,1-jk]fluorene, naphtho[4,5,6-abc]aceanthrylene, naphtho[5,4,3-abc]coronene, naphtho[7,8,1,2,3-pqrst]pentaphene, naphtho[7,8,1,2,3-tuvwx]hexaphene, naphtho[8,1,2-abc]coronene, naphtho[8,1,2-bcd]perylene, naphtho[8,1,2-cde]naphthacene, naphtho[8,1,2-cde]pentaphene, naphtho[8,1,2-efg]anthanthrene, naphtho[8,1,2-ghi]chrysene, naphtho[b',b]chrysene, naphthobenzanthrene, lin-naphthofluorene, 2,3-beta-naphthofluorene, nonacene, octacene, ovalene, paranaphthalene, pentacene, peri-pentacenopentacene, pentalene, pentaleno[1,2-b:4,5-b']dinaphthalene, pentanthrene, pentanthrene, pentaphene, perinaphthene, peropyrene, perylene, perylo[3,2,1,12-pqrab]perylene, 1H-phenalene, phenalene, phenaleno[12,3,4-ghij]perylene, phenalin, 2',3'-phenanthra-1,2-anthracene, 2',3'-phenanthra-2,3-phenanthrene, phenanthrene, [phenanthreno-9', 10':9, 10]-phenanthrene-1,1'methylene, phenanthrin, phenanthrindene, phenanthro[1,10,9,8-opqra]perylene, phenanthro[1,2,3,4-def]chrysene, phenanthro[1,2,3,4-ghi]perylene, phenanthro[1,2-a]naphthacene, phenanthro[1,2-b]chrysene, phenanthro[1,2-b]triphenylene, phenanthro[10,1,2,3-cdef]fluorene, phenanthro[10,1,2-abc]coronene, phenanthro[2,1,10,9,8,7-pqrstuv]pentaphene, phenanthro[2,1,10,9,8,7-tuvwxyz]hexaphene, phenanthro[2,1-b]chrysene, phenanthro[2,1-f]picene, phenanthro[2,3,4,5-tuvab]picene, phenanthro[2,3-c]chrysene, phenanthro[2,3-g]chrysene, phenanthro[3,2-b]chrysene, phenanthro[3,2-g]chrysene, phenanthro[3,4-a]anthracene, phenanthro[3,4-a]naphthacene, phenanthro[3,4-b]chrysene, phenanthro[3,4-b]triphenylene, phenanthro[3,4-c]chrysene, phenanthro[3,4-c]phenanthrene, phenanthro[4,3,2,1-def]chrysene, phenanthro[4,3-a]anthracene, phenanthro[4,3-b]chrysene, phenanthro[5,4,3,2-abcde]perylene, phenanthro-[9,10,1,2,3-pqrst]pentaphene, phenanthro[9,10,1-qra]naphthacene, phenanthro[9,10-a]naphthacene, phenanthro[9,10-b]chrysene, phenanthro[9,10-b]triphenylene, 4,5-phenanthrylenemethane, phene, 5,6-(1,2-phenylene)naphthacene, 1,10-(1,2-phenylene)pyrene, 1,10-(o-phenylene)pyrene, 2,3-(o-phenylene)pyrene, 1,9-phenyleneanthracene, 5,6-o-phenylenenaphthacene, 10,11-phenylenenaphthacene, 2,3-phenylenepyrene, o-phenylenepyrene, picene, pyranthrene, pyren, pyrene, peri-pyrene-1,10(CH2)-indene, pyrenindene, pyreno[1,10,9-abc]coronene, pyreno[10,1,2-abc]coronene, pyreno[2,1-b]picene, pyreno[5,4,3,2,1-pqrst]pentaphene, rubicene, terrylene, tetrabenz[a,c,h,j]anthracene, tetrabenzo[a,c,hi,mn]naphthacene, tetrabenzo [a,c,hi,qr]pentacene, tetrabenzo[a,cj,l]naphthacene, tetrabenzo[a,c,l,n]pentacene, tetrabenzo[a,cd,f,lm]perylene, tetrabenzo[a,cd,j,lm]perylene, tetrabenzo[a,e,j,o]-perylene, tetrabenzo[a,f,j,o]perylene, tetrabenzo[a,f,k,n]perylene, tetrabenzo[bc,ef,hi,kl]coronene, tetrabenzo[bc,ef,kl,no]coronene, tetrabenzo[de,h,kl,rst]pentaphene, tetrabenzo[de,hi,mn,qr]naphthacene, tetrabenzo[de,hi,op,st]pentacene, tetrabenzo[de,jk,op,uv]pentacene, 1,2:3,4:5,6:7,8-tetrabenzonaphthalene, tetracene, tetrahelicene, tetraphene, tribenz[a,c,h]anthracene, 1,2,3,4,5,6-tribenzanthracene, tribenzo[a,c,j]naphthacene, 8H-tribenzo[a,cd,l]pyrene, tribenzo[a,cd,lm]perylene, tribenzo[a,e,ghi]perylene, tribenzo[a,ef,hi]coronene, tribenzo[a,ef,no]coronene, tribenzo[a,f,j]perylene, tribenzo[a,ghi,k]perylene, tribenzo[a,hi,kl]coronene, tribenzo[a,hi,mn]naphthacene, tribenzo[a,i,l]pyrene, tribenzo[b,def,p]chrysene, tribenzo[b,e,ghi]perylene, tribenzo[b,g,k]chrysene, tribenzo[b,g,l]chrysene, tribenzo[b,g,p]chrysene, tribenzo[b,n,pqr]perylene, tribenzo[c,g,mno]chrysene, tribenzo[de,ij,rst]pentaphene, tribenzo[de,kl,rst]pentaphene, tribenzo[fgh,pqr,zalbl]trinaphthylene, tribenzo[jk,qr,uv]naphtho[2,1,8,7-defg]pentacene, tribenzobicyclo[2.2.2]octatriene, triindeno[2,3:2',':2", 3"]benzene, trinaphthylene, trinaphthylenebenzene, triphenylene, triptycene, truxene, and zethrene.

One non-limiting embodiment of a suitable amphipathic monomer of the present invention includes the following structure (XI):

XI

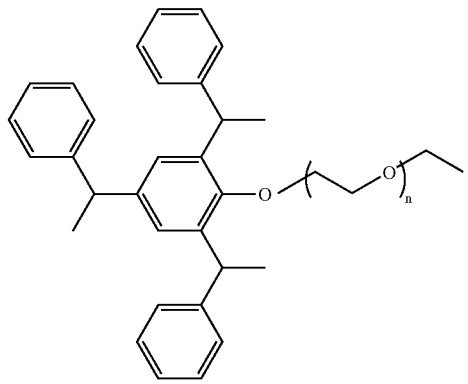

wherein n is from 1 to 100. A particular non-limiting embodiment described herein as an example includes inventive copolymers with the amphiphatic monomer (XI) wherein n is about 25, copolymerized in the form of a tristyryl phenol-capped poly(ethylene oxide) ester of methacrylic acid.

Hydrophobic Monomer

The inventive copolymers may optionally include a third monomer that is hydrophobic. The optional hydrophobic monomer may be selected from any monomer that has a uncharged and/or neutral hydrophobic group or moiety. Suitable uncharged neutral (nonionic) monomers are disclosed in U.S. Pat. No. 5,547,612 to Austin, et al., and include for example, but are not limited to C1-C6 alkyl esters of (meth) acrylic acid, acrylamide and the C1-C6 alkyl-substituted acrylamides, N-alkyl-substituted acrylamides, N-alkanol-substituted acrylamides, C1-C6 alkyl esters and C1-C6 alkyl half-esters of unsaturated vinylic acids, such as maleic acid and itaconic acid, C1-C6 alkyl esters of saturated aliphatic monocarboxylic acids, such as acetic acid, propionic acid and valeric acid, methyl (meth)acrylate, mono- and dimethyl maleate, mono- and di-ethyl itaconate, and (meth)allyl acetates, propionates and valerates.

In addition, suitable hydrophobic monomers may be selected from materials corresponding to the general formula (XII):

$$[A2]_{n'}LW \qquad \text{XII}$$

wherein A2 may be selected from A; n' represents the total number of carbon and/or silicone atoms in the A2 group, being from 1 to about 1000; and L and Y are as described hereinabove. Additionally, the hydrophobic radical of the hydrophobic monomer (A2) may be a radical selected from an alkylsilane, alkoxysilane, alkylsiloxane, alkoxysiloxane, aminosiloxane, organosiloxane, silazane, silane, organo-H-silane, silicone, silsesquioxane, perfluoroalkane, fluorooxetanes, perfluoroalkyl-silane, perfluorosilane, perfluoroalkyl-siloxane, perfluoroalkoxyl-siloxane, perfluoro-siloxane, and/or combinations thereof.

Without being bound by theory, it is believed that inclusion of the third, optional hydrophobic monomer in the inventive copolymers is desirable for the purpose of modifying polymer solubility and dispersibility characteristics for use in compositions employing an aqueous and/or aqueous based solvent, or non-aqueous solvent as a liquid carrier. The amount and nature of hydrophobic monomer may also be selected to enhance copolymer substantivity through increased partitioning or exhaustion of the copolymers onto target surfaces, particularly more hydrophobic substrates and materials. Selection of the hydrophobic radicals from the A2 group is preferred for enhancing inventive copolymer substantivity and surface modification of extremely hydrophobic materials, including, for example, but not limited to silicone and fluorinated materials such as silicone resins, silicone caulk, polytetrafluoroethylene (PTFE), fluoropolymers and fluororesins, and the like.

When present, the level of the optional hydrophobic monomer is less than about 50 mol % and generally less than 10 mol % of the copolymer.

Cationic Monomer

The inventive copolymers may optionally include a fourth cationic monomer. The optional fourth cationic monomer may be selected from monomers having a permanent cationic charge or monomers capable of forming a cationic charge on protonation.

Examples of permanently cationic monomers include, but are not limited to, quaternary ammonium salts of substituted acrylamide, methacrylamide, acrylate and methacrylate, such as trimethylammoniumethylmethacrylate, trimethylammoniumpropylmethacrylamide, trimethylammoniumethylmethacrylate, trimethylammoniumpropylacrylamide, 2-vinyl N-alkyl quaternary pyridinium, 4-vinyl N-alkyl quaternary pyridinium, 4-vinylbenzyltrialkylammonium, 2-vinyl piperidinium, 4-vinyl piperidinium, 3-alkyl 1-vinyl imidazolium, diallyldimethyl-ammonium, and the ionene class of internal cationic monomers as described by D. R. Berger in *Cationic Surfactants, Organic Chemistry*, edited by J. M. Richmond, Marcel Dekker, New York, 1990, ISBN 0-8247-8381-6, which is incorporated herein by reference. This class includes co-polyethyleneimine, co-poly ethoxylated ethylene imine and co-poly quaternized ethoxylated ethyleneimine, co-poly [(dimethylimino) trimethylene(dimethylimino)hexamethylene disalt], co-poly[(diethylimino) trimethylene(dimethylimino)trimethylene disalt], co-poly [(dimethylimino)2-hydroxypropyl salt], co-polyquarternium-2, co-polyquarternium-17, and co-polyquarternium-18, as described in the *International Cosmetic Ingredient Dictionary,* 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy) phenyl]tetrahydrothiophenium chloride. The counterion of the cationic co-monomer can be selected from, for example, chloride, bromide, iodide, hydroxide, phosphate, sulfate, hydrosulfate, ethyl sulfate, methyl sulfate, formate, and acetate. Examples of monomers that are cationic on protonation include, but are not limited to, acrylamide, N,N-dimethylacrylamide, N,N-di-isopropylacryalmide, N-vinylimidazole, N-vinylpyrrolidone, ethyleneimine, dimethylaminohydroxypropyl diethylenetriamine, dimethylaminoethylmethacrylate, dimethylaminopropylmethacrylamide, dimethylaminoethylacrylate, dimethylaminopropylacrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of 2-11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95-135. All three references are hereby incorporated by reference.

When present, the level of the optional permanent cationic charged fourth monomer is less than the total molar content of the first acidic monomer(s) constituent(s) of the inventive copolymers. When present, the level of the optional fourth monomer capable of forming a cationic charge on protonation is below about 50 mol % and generally less than 10 mol % of the copolymer.

Copolymer Synthesis

The copolymers are formed by copolymerizing the desired monomers. Conventional polymerization techniques can be employed. Illustrative techniques include, for example, solution, suspension, dispersion, or emulsion polymerization. A preferred method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersible or water-soluble. Some non-limiting embodiments of the inventive copolymers contain acrylamide, methacrylamide and substituted acrylamides and methacrylamides, acrylic and methacrylic acid, and esters thereof. Suitable synthetic methods for these copolymers are described, for example, in Kirk-Othmer, *Encyclopedia of Chemical Technology*, Volume 1, Fourth Ed., John Wiley & Sons, which is hereby incorporated by reference.

Aqueous Carrier

The compositions of the present invention may comprise an aqueous liquid carrier that includes water, and optionally one or more organic solvents. Water typically comprises from about 50% to 100%, or from about 60% to about 98%, and alternatively from about 80% to about 99.9% of the aqueous carrier, with the optional solvent forming the balance. Deionized or softened water is preferred.

In compositions employing the inventive copolymers further containing a surfactant or other cleaning adjunct for use in no-rinse cleaning, the aqueous carrier typically comprise about 98% to about 99.99%, or alternately from about 99% to about 99.99%, or from about 99.5% to about 99.99%, of the composition.

Solvent

The solvent is typically used to dissolve various components in the improved cleaning composition so as to form a substantially uniformly dispersed mixture, and thus may act as an alternative non-aqueous liquid carrier for the inventive polymers, or be used in combination with an aqueous liquid carrier. The solvent can also function as (i) a cleaning agent to loosen and solubilize greasy or oily soils from surfaces, (ii) a residue inhibiting agent to reduce residues left behind on a cleaned surface, (iii) a detergent agent, and/or (iv) a disinfecting, sanitizing, and/or sterilizing agent.

The solvent, when used, can be premixed with the other components of the cleaning composition or be partially or fully added to the improved cleaning composition prior to use. The solvent may be a water soluble and/or a water dispersible organic solvent. The solvent can be selected to have the desired volatility depending on the cleaning application.

Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpene derivatives can be mixed with a water soluble solvent when employed.

When water insoluble solvents are mixed with a water soluble solvent for the cleaning composition, the amount of the water insoluble solvent in the cleaning composition is generally less than about 10% typically less than about 5% and more typically less than about 1% of the cleaning composition. Typically the solvent should range from 0.01% to 10%. As can be appreciated, the cleaning composition can be a non-aqueous cleaner wherein little, if any, water is used. in such formulations, amount of the water insoluble solvent can be greater than about 10%.

Suitable water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and their homologues. Certain terpene derivatives that can be used include, but are not limited to, d-limonene and dipentene. Pyrrolidones include, but are not limited to, N-methyl-2-pyrrolidone, N-octyl-2-pyrrolidone and N-dodecyl-2-pyrrolidone. In one particular formulation of the cleaning composition, the solvents can include, but are not limited to, n-propanol, isopropanol, butanol, ethyleneglycol butylether, diethyleneglycol butylether, propyleneglycol butylether, dipropyleneglycol butylether, and/or Hexyl Cellusolve™. in another particular preferred formulation, the solvent includes isopropanol and/or propyleneglycol butylether.

Typically, the inventive composition, when used for cleaning, includes at least about 0.1% solvent to avoid solubility problems which can result from the combination of various components of the cleaning composition. The amount of the solvent in the cleaning composition may exceed about 70% when formulated as a concentrate. Generally, in light of environmental considerations owing to air quality, volatile organic carbon content (VOC) solvents are used at levels not exceeding about 5% in the final use composition.

Surfactant

The cleaning composition may include an effective amount of surfactant for (i) improving the cleaning performance (e.g., by improving wetting properties), (ii) stabilizing the cleaning composition, and (iii) emulsifying the cleaning components. Conventional nonionic, anionic, cationic, zwitterionic, and/or amphoteric surfactants can be employed. Suitable surfactants are described in *McCutcheon 's Emulsifiers and Detergents* (1997), Kirk-Othmer, Encyclopedia of Chemical Technology, 3rd Ed., Volume 22, pp. 332-432 (Marcel-Dekker, 1983), and *McCutcheon's Soaps and Detergents* (N. Amer. 1984), which are incorporated herein by reference.

Suitable surfactants include, but are not limited to, glycoside, glycols, ethylene oxide and mixed ethylene oxide/propylene oxide adducts of alkylphenols and alcohols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, cocoamphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl polyether alcohols, salts of higher alkyl substituted imadazolinium dicarboxylic acids, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and imidazolines.

Lauryl sulfate, laurylether sulfate, cocamidopropylbetaine, alkyl polyglycosides, and amine oxides can also be employed as surfactants. The amine oxides can be ethoxylated and/or propoxylated. One specific amine oxide includes, but is not limited to, alkyl di (hydroxy lower alkyl) amine oxides, alkylamidopropyl di (lower alkyl) amine oxides, alkyl di (lower alkyl) amine oxides, and/or alkylmorpholine oxides, wherein the alkyl group has 5-25 carbons and can be branched, unbranched, saturated, and/or unsaturated. Non-limiting examples of amine oxides include, but are not limited to, lauryldimethylamine oxide sold under the name BARLOX 12 from Lonza.

The alkyl polyglycosides are typically formed by reacting a sugar with a higher alcohol in the presence of an acid catalyst, or by reacting a sugar with a lower alcohol (for example, methanol, ethanol, propanol, butanol) to thereby provide a lower alkyl glycoside, which is then reacted with a higher alcohol. The higher alcohol generally has the formulation $R_1O(R_2O)_xH$, wherein $R_1$ represents a straight or branched alkyl, alkenyl, or alkylphenyl group having from 2 to 30 carbon atoms, $R_2$ represents an alkylene group having from 2 to 20 carbon atoms, and X is a mean value that is 0 to 10. Specific non-limiting examples of the higher alcohol are straight or branched alkanol such as hexanol, heptanol, octanol, nonanol, decanol, dodecanol, tridecanol, tetradecanol, pentadecanol, hexadecanol, heptadecanol, octadecanol, methylpentanol, methylhexanol, methylheptanol, methyloctanol, methyldecanol, methylundecanol, methyltridecanol, methylheptadecanol, ethylhexanol, ethyloctanol, ethyldecanol, ethyldodecanol, 2-heptanol, 2-nonanol, 2-undecanol, 2-tridecanol, 2-pentadecanol, 2-heptadecanol, 2-butyloctanol, 2-hexyloctanol, 2-octyloctanol, 2-hexyldecanol and/or 2-octyldecanol; an alkenol such as hexenol, heptenol, octenol, nonenol, decenol, undecenol, dodecenol, tridecenol, tetradecenol, pentadecenol, hexadecenol, heptadecenol and octadecenol, and alkylphenols such as octylphenol and nonylphenol. These alcohols or alkylphenols may be used either alone or a mixture of two or more of them.

Further, an alkylene oxide adduct of these alcohols or alkylphenols can be used. The sugar used to form the alkyl glycoside includes, but is not limited to, monosaccharides, oligosaccharides, and polysaccharides. Non-limiting examples of the monosaccharides include aldoses such as, but not limited to, allose, altrose, glucose, mannose, gulose, idose, galactose, talose, ribose, arabinose, xylose, and lyxose. Non-limiting examples of the oligosaccharides include maltose, lactose, sucrose and maltotriose. Non-limiting examples of the polysaccharides include hemicellulose, insulin, dextrin, dextran, xylan, starch and/or hydrolyzed starch. Specific alkyl glycosides that can be used are represented by the following formula: $D_1O(D_2O)_xH_y$, wherein $D_1$ is an alkyl, alkenyl, or alkylphenyl group having from 6 to 30 carbon atoms, $D_2$ is an alkylene group having from 2 to 20 carbon atoms, H is a residual group originating from a reducing sugar having 2 or 10 carbon atoms, x is a mean value that is 0 to 10, and y is a mean value that is 1 to 10. Non-limiting examples of alkyl polyglycosides include, but are not limited to, the APG series of alkyl polyglycosides available from Cognis.

Surfactants may also include ethoxylated alcohols having an alkyl group typically with 6-22 carbons; the alkyl group is preferably linear but could be branched. Furthermore, the carbon groups can be saturated or unsaturated. Suitable ethoxylated alcohols include the SURFONIC L series surfactants by Huntsman. Fluorosurfactants can also be used as the surfactant. A suitable fluorosurfactant is an ethoxylated nonionic fluorosurfactant. Suitable ethoxylated nonionic fluorosurfactants include the ZONYL surfactants by DuPont.

Typically the surfactant is partially or fully soluble in water. When employed, the surfactant comprises at least about 0.001% and typically 0.01-10% of the cleaning composition. The amount of surfactant may exceed 10% when the cleaning composition is formulated in concentrate. Generally, the surfactant content is about 0.1-2%.

Antimicrobial Agent

An antimicrobial agent, such as for example a disinfectant and/or germicide, can also be included in the cleaning composition. Non-limiting examples of useful quaternary compounds that function as antimicrobial agents include benzalkonium chlorides and/or substituted benzalkonium chlorides, di($C_6$-$C_{14}$)alkyl di short chain ($C_{1-4}$ alkyl and/or hydroxyalkl) quaternary ammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyldimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the preferred low-surfactant compositions herein, range from about 0.001% to about 0.8% and generally from about 0.005% to about 0.3% of the usage composition. The weight percentage ranges for the biguanide and/or quat compounds in the cleaning composition is selected to disinfect, sanitize, and/or sterilize most common household and industrial surfaces.

Non-quaternary biocides are also useful in the present compositions. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics.

Preferred antimicrobial agents also include organic acids, such as, acetic, lactic, sulfamic and glycolic acids.

Builder/Buffer

The cleaning composition may include a builder detergent which increase the effectiveness of the surfactant. The builder detergent can also function as a softener and/or a sequestering and buffering agent in the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxy-sulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl) amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbonate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company and WO 95/07971 both of which are incorporated herein by reference.

When employed, the builder detergent comprises at least about 0.001% and typically about 0.01-5% of the cleaning composition. The amount of the builder detergent may exceed about 5% when the cleaning composition is formulated as a concentrate. Generally, the builder detergent content is about 0.01-2%.

Additional Adjuvants

The cleaning composition may includes additional adjuncts. The adjuncts include, but are not limited to, fragrances or perfumes, waxes, dyes and/or colorants, solubilizing materials, odor control agents, disinfectants, germicides, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermaceti, candelilla, paraffin, lanolin, shellac, esparto, ouricuri, polyethylene wax, chlorinated naphthalene wax, petrolatum, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, clays, and/or methyl, ethyl, or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases. Hydrotropes, when used include, but are not limited to, xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstats or bacteriostats, methyl, ethyl and propyl parabens, short chain organic acids (e.g. acetic, lactic and/or glycolic acids), bisguanidine compounds (e.g. Dantogard and Dantogard Plus both from Lonza, inc. and/or Glydant) and/or short chain alcohols (e.g. ethanol and/or IPA).

Suitable mildewstats or bacteriostats include, but are not limited to, mildewstats (including non-isothiazolone compounds) such as Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenylphenol, $Na^+$ salt, from Nipa Laboratories Ltd., DOWICIDE A, a 1,2-benzoisothiazolin-3-one, from Dow Chemical Co., and IRGASAN DP 200, a 2,4,4'-trichloro-2-hydroxydiphenylether, from Ciba-Geigy A.G.

Absorbent Materials

The cleaning composition of the present invention can be used independently from or in conjunction with an absorbent and/or adsorbent material. For instance, the cleaning composition can be formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material.

The cleaning wipe can be made of nonwoven material such as nonwoven, fibrous sheet materials or meltblown, coform, air-laid, spun bond, wet laid, bonded-carded web materials, and/or hydroentangled (also known as spunlaced) materials. The cleaning wipe can also be made of woven materials such as cotton fibers, cotton/nylon blends and/or other textiles. The cleaning wipe can also include wood pulp, a blend of wood pulp, and/or synthetic fibers, e.g., polyester, rayon, nylon, polypropylene, polyethylene, and/or cellulose polymers.

The absorbent material can be constructed as part of a single or multiple layer cleaning pad attached in either the wet or dry state to the end of a mop. The cleaning pads will preferably have an absorbent capacity, when measured under a confining pressure of 0.09 p.s.i. (pounds per square inch) after 20 minutes, of at least about 1 g deionized water per g of the cleaning pad, preferably at least about 10 g deionized water per g of the cleaning pad.

When the cleaning formulation is incorporated in an absorbent material, the cleaning composition may include an effective amount of release agent to increase the amount of polymer released from the cleaning wipe onto a surface. The release agent is preferably an ionic species designed to compete with the polymer for sites on the cleaning wipe thereby causing increased polymer release from the cleaning wipe during use of the cleaning wipe. The release agent may include a salt. A variety of different salts can be used such as, but not limited to, monovalent salts, divalent salts, organic salts, and the like. Preferably, the effective ionic strength of the release agent in the cleaning composition is at least about $5\times10^{-3}$ mol/l.

Treating Textile Surfaces

The inventive compositions can be applied to textiles to modify their surfaces to render them hydrophilic and more receptive to interactions with aqueous solutions or formulations. The textiles can be either woven or non-woven; the materials can be natural, e.g., cotton, and/or synthetic, e.g., comprise fibers made from synthetic polymeric substrates as described herein, including for example, but not limited to polyester and nylon. The specific fabric is not critical.

Treating Hard Surfaces

The inventive compositions can be also applied to hard materials to modify their surfaces to render them hydrophilic and thereby exhibit improved "next time cleaning." Hard surfaces include those made from metal, plastic, stone both natural and synthetic, e.g., plastic and polymeric substrates such as for example CORIAN, glass, ceramic, glazed tile, porcelain and the like. These are commonly found among household fixtures including, for example, tiles, bathtubs, towel bowl, kitchen countertops, floors, and windows. in addition, the compositions can be used on the interior and exterior surfaces of cars, boats, and other vehicles, including the finished and painted surfaces thereof, and portions thereof comprising metal, glass, rubber, plastic, and other polymeric materials.

Articles treated according to the inventive methods and compositions as described herein may be selected from those articles of construction comprising polymeric substrates that normally exhibit hydrophobic surface properties in that they exhibit the tendency to bead water when water is applied to their untreated surfaces. Articles include those wholly constructed of, laminated with, and/or coated with a hydrophobic polymeric substrate.

Polymeric substrates include condensed polymers which are rendered into materials of construction having at least one treatable surface. These polymeric substrates can be in any physical form, for example, but are not limited to, panels, molded forms, foams, sheets, solid surfaces, laminated films and coatings on a secondary substrate, and the like. The polymeric substrates may have any desired physical properties, for example, but not limited to, forms that are substantially elastic, non-elastic, flexible, compressible, or essentially rigid, and combinations thereof.

Methods and compositions of the present invention may be employed to modify at least one treatable surface comprising a hydrophobic polymeric substrate, including for example, but not limited to, plastics, elastomers and laminates used in the construction of floors, tiles, panels, walls, doors, ceilings, bathtubs, shower stalls, sinks, cabinets, countertops, fixtures, and the like.

Polymeric substrates and articles constructed thereof that may be treated include, but are not limited to polyethylene terephthalate, polyamide, polyurethane, polyester, polyethylene, polyvinyl chloride (PVC), chlorinated polyvinylidene chloride, polyacrylamide, polystyrene, polypropylene, polycarbonate, polyaryletherketone, poly(cyclohexylene dimethylene cyclohexanedicarboxylate), poly(cyclohexylene dimethylene terephthalate), poly(cyclohexylene dimethylene terephthalate)glycol, polyetherimide, polyethersulfone, poly (ethylene terephthalate) glycol, polyketone, poly(oxymethylene), polyformaldehyde, poly(phenylene ether), poly(phenylene sulfide), poly(phenylene sulfone), polystyrene, polysulfone, polytetrafluoroethylene, polyurethane, poly(vinylidene fluoride), polyamide, polyamide thermoplastic elastomer, polybutylene, polybutylene terephthalate, polypropylene terephthalate, polyethylene naphthalate, polyhydroxyalkanoate, polyacrylate, poly(methyl)methacrylate (PMMA), polytrimethylene terephthalate, polyvinylidene chloride and combinations thereof.

Further examples of suitable polymeric substrates include those copolymeric materials made from one or more monomers selected from acrylate, acrylonitrile, butadiene, ethylene, formaldehyde, maleic anhydride, melamine, methacrylate, methyl methacrylate, phenol, propylene, styrene, urethane, and vinyl acetate. Some examples of these copolymeric materials (and their common industrial acronyms) include acrylonitrile:butadiene:styrene (ABS), acrylonitrile: styrene:acrylate (ASA), ethylene:propylene (E/P), ethylene: vinyl acetate (EVAC), methyl methacrylate:acrylonitrile:butadiene:styrene (MABS), methacrylate:butadiene:styrene (MBS), melamine:formaldehyde (MF), melamine:phenol: formaldehyde (MPF), phenol:formaldehyde (PF), styrene: butadiene (SB), styrene:maleic anhydride (SMAH), styrene: acrylonitrile (SAN), styrene:butadiene (SBC), vinyl acetate: ethylene copolymer (VAE), and combinations thereof.

Other polymeric substrates and articles constructed thereof that may be treated include those constructed of thermoplastic elastomers including, but not limited to, copolyester thermoplastic elastomer (TPC), olefinic thermoplastic elastomer (TPO), styrenic thermoplastic elastomer (TPS), urethane thermoplastic elastomer (TPU), thermoplastic rubber vulcanisate (TPV), rubber, neoprene, vinyl, silicone elastomer, and combinations thereof.

Reactive Materials

Polymer gels can be applied to selected surface areas in order to create localized reaction sites. For example, a polymer gel that includes a first reactant material and that is formed on a region on a surface may subsequently be exposed to a second reactant material to create a chemical reactant. The choice of the reactants is not critical although they should preferably be water soluble or water dispersible. For example, a first reactant may be phenolphthalein and a second reactant may be sodium hydroxide. Other reactant pairs include: (i) an ester of a fatty acid and sodium hydroxide and commercially available enzyme such as savinase or lipase and substrate such as a greasy or starchy soil.

The following examples illustrate non-limiting embodiments of treatment and cleaning compositions of the invention. The examples are for illustrative purposes only and are not meant to limit the scope of the invention in any way.

EXAMPLES

Various formulations of the inventive treatment and cleaning composition were prepared and tested according to the methods disclosed herein for treating a surface with the inventive polymers to provide surface protective benefits and surface modification effects determined with respect to a number of characteristics, including the following: (i) resistance of surface modification to water challenge (substantivity) and (ii) soap-scum soil build-up prevention, and (iii) hydroscopic polymer gel formation.

Substantivity Test Method

The ability of the inventive copolymers to effectively modify surfaces and maintain the favorable benefits described herein are measured using a substantivity test method which challenges treated surfaces to determine the resistance of surface modification to water treatment. A good measure of substantivity is the ability of treated surfaces to exhibit a continuing and pronounced water sheeting effect owing to the hydrophilic surface modification provided by the inventive copolymers. The water sheeting effect is readily observed on treated surfaces when applied water tends to form a continuous sheet which flows and drains quickly from the surface leaving essentially little, if any, adhered water droplets behind. Normally hydrophobic polymeric substrates, such as plastics, do not typically exhibit a water sheeting effect, rather water tends to bead on the surfaces forming isolated water droplets. Copolymers of the present invention do not permanently modify the treated surfaces, however providing some degree of extended modification that provides surface protection benefits yet enables effective cleaning and/or easier cleaning of the surface following treatment. The transient nature of the inventive copolymers surface modification is observable by repeated challenging of the treated surface with water, and noting when the surface modification effect is significantly reduced. Reduction in the water sheeting effect is readily observed when water beading occurs, noted by the formation of non-flowing individual water droplets remaining in place on a treated panel of the test material, over an area greater than about a quarter (>25%) of the total surface area of the panel. The substantivity test is performed by spraying approximately 4 milliters (mL) of a test formulation, using a manual trigger sprayer, onto a clean 4"×4" square test panel held in a slightly vertically inclined position (about 10°), after which the test panel is allowed to dry, and is then rinsed once with approximately 6 mL of distilled and deionized water ($ddH_2O$) using a powered spray device. Any manually operated trigger sprayer, such as the T8500 sprayer commercially available from Continental Spray International can be used to apply the test formulations. A Febreze™ Power Sprayer, available from the Procter & Gamble Company, Cincinnati, Ohio was used to apply the water rinse for uniformity in evaluating substantivity. Test surfaces employed included polystyrene (PS), polyvinylchloride (PVC), polymethylmethacrylate (PMMA or "acrylic"), glass and glazed ceramic tile ("ceramic"). After the first initial rinse following treatment of the test panels with the test formulations, the number of rinses (cycles) with $ddH_2O$ required to diminish the water sheeting effect on greater than a quarter of the test surface area was counted. The number of rinses (cycles) represents the relative score ("Substantivity score") which may be compared to that of an untreated, clean test surface subject to the same test, or a test surface treated with a comparison or control formulation. In general, a score of equal to or greater than about 1 indicates the ability of a test formulation to modify the treated surface to exhibit a water sheeting effect and exhibit suitable substantivity. Higher substantivity scores greater than about 1 indicate greater substantivity of the inventive copolymers to remain on the treated surfaces and their effectiveness in maintaining the beneficial surface modification properties described herein following multiple rinses with water. Various non-limiting embodiments of the inventive copolymers form polymer gels on surfaces treated according to the methods described herein to provide substantivity scores on various substrates from 1 to about 15.

Soap Scum Resistance Test Method

The ability of the inventive copolymers to effectively modify surfaces and maintain the favorable benefits described herein are further measured using a soap scum resistance test method which challenges treated surfaces with soap solutions to determine the resistance of surface modification to soiling. In the test method, treated test panels are produced as described hereinabove and allowed to dry without a rinsing step to represent a direct application of the inventive compositions to surfaces or articles, for example those found within a shower or bath area, subject to soap scum exposure.

Treated test panels are then sprayed with 6 mL of a solution consisting of 100 ppm of Ivory Soap in hard water (300 ppm by weight solution of a 3:1 weight % mixture of calcium: magnesium chloride in water), followed by a second rinse with the hard water solution alone to represent one challenge cycle. The test panel is allowed to dry completely (approximately 10 minutes) before the next challenge cycle is performed. After 5 complete cycles, the test panels are allowed to dry completely and then evaluated for soap and/or hard water spots and compared by visual grading, using a 5 point scale for evaluation, where a score of 1=Dirty and a score of 5=Clean, corresponding to the "Soap Scum Resistance score." A Soap Scum Resistance score greater than 1 represents a suitably improved surface protective benefit provided by treating the substrate with the inventive copolymers. A clean, untreated panel of the same test material is also provided for visual comparison, representing a score of 5 on the scale. In addition, digital photographic images of each tile are recorded after 5, 10, and 15 cycles of testing.

Chemical Key

AA=acrylic acid

AMPS=2-propenyl allyl ester of methacrylic acid

MMA=methylmethacrylic acid

NNDMA=N,N-dimethylacrylamide

SEM-25=Sipomer SEM-25 monomer, available from Rhodia Corporation tBAEMA=tert-butylaminoethyl methacrylate, MHOROMER BM615, available from Rohm America—Degussa Corporation tOAM=tert-octylmethylacrylamide APG325N=nonionic alkylpolyglucoside surfactant available from Cognis, Cincinnati, Ohio.

Dowfax 2A1=sodium xylene sulfonate, available from Dow Chemical Co., Midland, Mich.

Dowanol DPNB=dipropylene glycol mono-n-butyl ether, available from Dow Chemical Co.

Copolymer Key (Monomer Mole Ratio)

Polymer A=AA(1):tBAEMA(1)

Polymer B=AA(9):tBAEMA(1)

Polymer C=AA(1):tBAEMA(3) Na salt

Polymer D=AA(50):tBAEMA(50)

Polymer E=AA(47.5):tBAEMA(47.5):tOAM (5)

Polymer F=SEM-25 (80):MAA (20), average MW=14 K

Polymer G=AA(60):SEM-25 (32):MAA (8), average MW=3.3 K

Polymer H=AA(90):SEM-25 (8):MAA (2)

Polymer I=AA(83):SEM-25 (13.6):MAA (4.4), average MW=10 K

Polymer J=AA(83):SEM-25 (13.6):MAA (4.4), average MW=5 K

Polymer K=SEM-25(2):MMA(0.5):AMPS(97.5), low MW

Polymer L=SEM-25(2):MMA(0.5):AMPS(97.5), high MW

Polymer M=SEM-25(4):MMA(1):AMPS(95), Low MW

Polymer N=SEM-25(4):MMA(1):AMPS(95), High MW

Polymer O=SEM-25(7.6):MMA(1.9):AMPS(90.5), High MW

Polymer P=SEM-25(13.8):MMA(3.5):AMPS(82.7), Low MW

Polymer Q=SEM-25(13.8):MMA(3.5):AMPS(82.7), High MW

Polymer R=SEM-25(22.4); MMA (5.6):AMPS (72), Low MW

Polymer S=SEM-25(27.2); MMA (6.8):AMPS (66), Low MW

Polymer T=NNDMA(50):tBAEMA(50)
Polymer U=NNDMA(80):tBAEMA(20)

EXAMPLE 1

Cleaning compositions employing non-limiting embodiments of the inventive copolymers were prepared and tested on a variety of plastic surfaces to measure the substantivity of the copolymers to different polymeric substrates and their effectiveness at maintaining beneficial surface protective properties under challenge. Inventive copolymers A-E were formulated at a level of 2.0 wt % in an aqueous solution containing 1.0 wt % of a nonionic surfactant (APG325N) and adjusted to the final pH indicated in Table 1 using an appropriate amount of glycolic acid. Formulations were tested according to the Substantivity Test Method described hereinabove.

Results presented in Table 1 reveal that the exampled inventive copolymers of acrylic acid and tert-butylaminoethylmethacrylate are effective at depositing onto the polymeric substrates from an aqueous solution, and modifying the surfaces to exhibit water sheeting benefits over numerous rinsing cycles. The substantivity scores are all greater than 1, demonstrating good initial adherence, and higher scores demonstrating resistance to rinsing while maintaining favorable sheeting benefits up to 11 rinse cycles. The tBAEMA monomer of the copolymers is a fairly low molecular weight amphipathic monomer. Comparison of copolymers A through D with varying ratios of the acidic and amphipathic monomer reveal that the resulting copolymer monomer composition may be varied without significantly impacting substantivity to polymeric substrates. While substantivity is aided at lower pH's around pH 4, the formulated copolymer composition pH may be raised to pH 7 and above and still exhibit acceptable performance and substantivity. Copolymer E results indicate that a terpolymer further containing an optional hydrophobic comonomer, tert octylacrylamide (tOAM), provides slightly enhanced substantivity to the hydrophobic substrates.

TABLE 1

| | Conditions | Substantivity Score | | |
|---|---|---|---|---|
| Polymer | pH | Acrylic | PVC | Polystyrene |
| A | 4 | 11 | 11 | 11 |
| B | 4 | 9 | 11 | 11 |
| C | 7 | 3 | 3 | 3 |
| D | 2.5 | 7 | 7 | 7 |
| E | 2.5 | 8 | 8 | 8 |

EXAMPLE 2

Inventive copolymers F-J, featuring non-limiting embodiments having alternative acidic monomer and amphipathic monomers, at varying ratios, were formulated at a level of 2.0 wt % in an aqueous solution containing 1.0 wt % of a nonionic surfactant (APG325N), then adjusted to their final pH using an appropriate amount of glycolic acid. The formulations were tested according to the Substantivity Test Method with results presented in Table 2 showing that all copolymers are effective at depositing onto the polymeric substrates from an aqueous solution, and modifying the surfaces to exhibit water sheeting benefits over numerous rinsing cycles. For copolymers F and G, a tendency for increased substantivity on the more hydrophobic PVC and polystyrene substrates is noted. Effects of alternative monomer compositions is seen in non-limiting embodiments of terpolymers G and H which comprise differing ratios of the acidic monomers acrylic acid and methacrylic acid and an amphipathic monomer. Excellent substantivity is observed at higher levels of the amphipathic monomer in terpolymer G, however even at much lower amphipathic monomer content, effective substantivity is still demonstrated by terpolymer H on all three representative polymer substrates.

The effect of relative polymer molecular weight is demonstrated by inventive non-limiting embodiments of terpolymers I and J, which feature essentially identical monomer weight ratios, but which were polymerized under conditions providing relatively high and low averaged molecular weight polymers, respectively. Substantivity results provided in Table 2 demonstrate excellent surface modification properties on all three representative substrates. The lower average molecular weight terpolymer exhibits slightly decreased substantivity on two of the substrates, although overall performance remains excellent. This demonstrates that the degree of polymerization (average molecular weight) as well as relative monomer ratios of the inventive copolymers may be independently selected for optimizing substantivity on specific substrates, or selected to optimize substantivity across a variety of materials for general applications.

TABLE 2

| | Conditions | Substantivity Score | | |
|---|---|---|---|---|
| Polymer | pH | Acrylic | PVC | Polystyrene |
| F | 2.5 | 5 | 6 | 9 |
| G | 2.5 | 5 | 10 | 10 |
| H | 2.5 | 6 | 7 | 6 |
| I | 2.5 | 10 | 9 | 10 |
| J | 2.5 | 7 | 6 | 10 |

EXAMPLE 3

Inventive copolymers K-S, featuring non-limiting embodiments having alternative acidic monomer and amphipathic monomers, at varying ratios, as well as differing average molecular weights were formulated at a level of 2.0 wt % in an aqueous solution containing 1.0 wt % of a nonionic surfactant (APG325N), then adjusted to their final pH using an appropriate amount of glycolic acid and/or sodium hydroxide. The effect of pH is first explored in Table 3 on an inventive non-limiting embodiment of a low molecular weight terpolymer comprising a relatively low amphipathic monomer content combined with methymethacrylate and 2-propenyl allyl ester of methacrylate (AMPS) monomers. Substantivity of terpolymer K is seen to be best on an acrylic substrate, with slightly lower substantivity on other plastics, and it is noted that overall substantivity behavior remains fairly independent of the formulation pH under the test conditions employed. A higher molecular weight terpolymer L, featuring the same monomer composition and relative monomer ratio as terpolymer K, exhibits improved substantivity across all substrates. Alternative copolymer non-limiting embodiments M, P, R and S feature low average molecular weight terpolymers of varying monomer content in which the amphiphatic monomer content is progressively enriched relative to the acidic monomer content. Results in Table 3 demonstrate an increasing substantivity on polystyrene with increasing amphiphatic SEM-25 monomer content, observed under treatment conditions of both high (pH 10.5) and low (pH 2.5) formulation pH. Substantivity of the terpolymer series on the other substrates is less effected by the amphiphatic content, although effects of formulation pH are more apparent, although overall surface modification of the series remains excellent over the varying conditions and terpolymer monomer compositions tested here.

TABLE 3

| | Conditions | Substantivity Score | | |
|---|---|---|---|---|
| Polymer | pH | Acrylic | PVC | Polystyrene |
| K | 2.5 | 3 | 1 | 1 |
| K | 10.8 | 3 | 1 | 1 |
| L | 2.5 | 6 | 2 | 2 |
| L | 10.8 | 4 | 3 | 2 |
| M | 2.5 | 7 | 4 | 2 |
| M | 10.8 | 7 | 4 | 4 |
| N | 2.5 | 10 | 5 | 4 |
| N | 10.8 | 7 | 5 | 3 |
| O | 2.5 | 7 | 6 | 6 |
| O | 10.8 | 8 | 5 | 6 |
| P | 2.5 | 10 | 7 | 8 |
| P | 10.8 | 7 | 6 | 7 |
| Q | 2.5 | 7 | 4 | 7 |
| Q | 10.8 | 5 | 8 | 10 |
| R | 2.5 | 5 | 5 | 9 |
| R | 10.8 | 7 | 7 | 10 |
| S | 2.5 | 9 | 9 | 10 |
| S | 10.8 | 8 | 6 | 10 |

EXAMPLE 4

Cleaning and treatment compositions employing the inventive copolymers were prepared according to the formulations presented in Table 4, further incorporating the optional surfactants, hydrotropes and solvents that may be combined with the copolymers when formulated into commercially useful products for treating surfaces. Substantivity was determined in a similar fashion as described above.

EXAMPLE 5

Results presented in Table 5 demonstrate that cleaning and treatment compositions employing the inventive copolymers all exhibit effective substantivity across the set of representative test substrates when formulated into cleaning and treatment compositions and used according to the methods of application disclosed herein. By varying the monomer constituents, relative monomer content, and copolymer average molecular weight, the inventive copolymers may be selected for optimal performance against a particular substrate, or conversely, selected to provide effective performance across a range of substrates, being particularly effective at modifying normally hydrophobic polymer substrates, including acrylic, polyvinylchloride and polystyrene materials to demonstrate both hydrophilic and water-sheeting effects that persist even after repeated rinsing challenges. Thus, the inventive copolymers demonstrate utility in modifying a variety of surfaces found throughout the auto, home and industrial environment that can be beneficially modified to exhibit extended surface protective properties that are, however, non-durable in nature. The inventive copolymers deliver non-durable surface modification, which has utility in providing some self-cleaning and maintenance benefits to treated surfaces owing to their ability to sheet water, protect the surface against wetting by oil, create low water contact angles which results in lowered energy of adhesion of the oil; and thereby assist in the removal of lightly adhered soils, stains, dust and bacteria from the surface even when rinsed with water alone. Further, improved cleaning and easier next time cleaning benefits are provided to the treated surfaces since the copolymers are readily removable and/or restorable with the application of a cleaning solution, followed by application of the inventive copolymers, or alternatively with the application of a cleaning composition formulated with the inventive copolymers, respectively. In either method, the second application of a cleaning composition employing the inventive copolymers serves to restore the surface protective benefit without excessively build-up or residue formation. Thus, the surfaces of treated materials with polymer gels comprising the inventive copolymers remain visually unchanged following initial treatment, as well as after subsequent reapplication and/or repeated treatments. Without being bound by theory, it is believed that the copolymers form polymer gels on the surface that are to some extent in equilibrium with soluble copolymers present in the aqueous treatment or cleaning compositions, such that a thin, invisible polymer gel layer that is a monolayer or more in thickness (0.1 nm to 500 nm) optimally forms on the treated surfaces. The non-durable nature, yet rapid formation of polymer gels on treated surfaces exposed only briefly to compositions containing the inventive copolymers indicates their preference to deposit on surfaces, further demonstrated herein with regard to their measured Substantivity score, but which also establish an equilibrium distribution that presents unfavorable build up on treated surfaces.

TABLE 4

| Composition Ingredient (wt %) | 1 | 2 | 3 | 4 | 5 | 6 | 7 | 8 | 9 | 10 | 11 |
|---|---|---|---|---|---|---|---|---|---|---|---|
| Polymer A | 2 | | | | | | | | | | |
| Polymer B | | 2 | | | | | | | | | |
| Polymer C | | | 2 | | | | | | | | |
| Polymer D | | | | 2 | | | | | | | |
| Polymer E | | | | | 2 | | | | | | |
| Polymer F | | | | | | 2 | 2 | | | | |
| Polymer G | | | | | | | | 2 | | | |
| Polymer H | | | | | | | | | 2 | | |
| Polymer I | | | | | | | | | | 2 | |
| Polymer J | | | | | | | | | | | 2 |
| Polymer M | | | | | | | | | | | |
| Polymer N | | | | | | | | | | | |
| Polymer P | | | | | | | | | | | |
| Polymer Q | | | | | | | | | | | |
| Polymer R | | | | | | | | | | | |
| Polymer S | | | | | | | | | | | |

TABLE 4-continued

| | | | | | | | | | | | |
|---|---|---|---|---|---|---|---|---|---|---|---|
| Polymer T | | | | | | | | | | | |
| Polymer U | | | | | | | | | | | |
| APG325N | — | — | 1 | 1 | 1 | 1 | 1 | 1 | 1 | 1 | 1 |
| Glycolic Acid | 1.5 | 1.5 | 1.5 | 1.5 | 1.5 | 1.5 | 1.5 | 1.5 | 1.5 | 1.5 | 1.5 |
| Dowfax 2A1 | | | | | | 0.55 | 0.55 | 0.55 | 0.55 | 0.55 | 0.55 |
| Solvent | | | | | | | 2.2 | | | | |
| Water (to 100%) | q.s. | q.s. | q.s. | q.s. | q.s. | q.s. | q.s. | q.s. | q.s. | q.s. | q.s. |
| pH | 6 | 2.2 | 2.5 | 2.5 | 2.5 | 2.5 | 2.5 | 2.5 | 2.5 | 2.5 | 2.5 |

| Composition Ingredient (wt %) | 12 | 13 | 14 | 15 | 16 | 17 | 18 | 19 | 20 | 21 |
|---|---|---|---|---|---|---|---|---|---|---|
| Polymer A | | | | | | | | | | |
| Polymer B | | | | | | | | | | |
| Polymer C | | | | | | | | | | |
| Polymer D | | | | | | | | | | |
| Polymer E | | | | | | | | | | |
| Polymer F | | | | | | | | | | |
| Polymer G | | | | | | | | | | |
| Polymer H | | | | | | | | | | |
| Polymer I | | | | | | | | | | |
| Polymer J | 2 | | | | | | | | | |
| Polymer M | | 2 | | | | | | | | |
| Polymer N | | | 2 | | | | | | | |
| Polymer P | | | | 2 | | | | | | |
| Polymer Q | | | | | 2 | 2 | | | | |
| Polymer R | | | | | | | 2 | | | |
| Polymer S | | | | | | | | 2 | | |
| Polymer T | | | | | | | | | 2 | |
| Polymer U | | | | | | | | | | 2 |
| APG325N | 1 | 1 | 1 | 1 | 1 | 1 | 1 | 1 | 1 | 1 |
| Glycolic Acid | 10 | 1.5 | 1.5 | 1.5 | 1.5 | 1.5 | 1.5 | 1.5 | 1.5 | 1.5 |
| Dowfax 2A1 | | | | | | 0.55 | | | | |
| Solvent | | | | | | 2.2 | | | | |
| Water (to 100%) | q.s. | q.s. | q.s. | q.s. | q.s. | q.s. | q.s. | q.s. | q.s. | q.s. |
| pH | 4.0 | 2.5 | 2.5 | 2.5 | 2.5 | 2.5 | 2.5 | 2.5 | 2.5 | 2.5 |

TABLE 5

| Composition | Substantivity Score | | |
|---|---|---|---|
| # | Acrylic | PVC | Polystyrene |
| 6 | 5 | 6 | 9 |
| 8 | 5 | 10 | 10 |
| 9 | 6 | 7 | 6 |
| 10 | 10 | 9 | 10 |
| 11 | 7 | 6 | 10 |
| 13 | 7 | 4 | 2 |
| 14 | 10 | 5 | 4 |
| 15 | 10 | 7 | 8 |
| 16 | 7 | 4 | 7 |
| 18 | 5 | 5 | 9 |
| 19 | 9 | 9 | 10 |

EXAMPLE 6

Due to the efficiency of the inventive copolymers in sequestering atmospheric water and forming hydroscopic polymer gels on surfaces, treated materials further exhibit effective resistance to soiling and soap scum build-up in addition to the observed water sheeting benefit. Thus, the inventive copolymers demonstrate particular utility in providing hydrophilic properties to normally hydrophobic substrates, such as plastic and polymeric materials, as well as other substrates including glass, metal and ceramic. Inventive copolymers D-J were formulated at a level of 2.0 wt % in an aqueous solution containing 1.0 wt % of a nonionic surfactant (APG325N), adjusted to their final pH using an appropriate amount of glycolic acid, and tested on three representative surfaces according to the Soap Scum Resistance Test Method. Results presented in Table 6 demonstrate that all copolymers are effective at providing resistance to soap scum buildup over at least one challenge cycle. Non-limiting embodiments with alternative amphiphatic and anionic monomer compositions and monomer ratios, as well as the terpolymer I and J differing in the average molecular weight, perform comparably.

TABLE 6

| | Conditions | Soap Scum Resistance Score | | |
|---|---|---|---|---|
| Polymer | pH | Acrylic | PVC | Ceramic |
| F | 2.5 | 3 | 4 | 3 |
| G | 2.5 | 4 | 4 | 3 |
| H | 2.5 | 3 | 3 | 3 |
| I | 2.5 | 4 | 4 | 3 |
| J | 2.5 | 4 | 2 | 3 |

EXAMPLE 7

Additional polymer non-limiting embodiments were tested on acrylic and PVC substrates with results presented in Table 7 that demonstrate effective soap scum resistance provided by terpolymers having varying ratios of amphipathic: acidic monomer content.

TABLE 7

| | Conditions | Soap Scum Resistance Score (1) | |
|---|---|---|---|
| Polymer | pH | Acrylic | PVC |
| M | 2.5 | 2.2 | 2.3 |
| N | 2.5 | 2.6 | 2.9 |
| P | 2.5 | 3.8 | 3.9 |
| Q | 2.5 | 4.2 | 4.2 |
| R | 2.5 | 2.4 | 2.7 |
| S | 2.5 | 2.9 | 3.9 |

(1) Score represents average of two trials.

EXAMPLE 8

Results presented in Table 8 demonstrate several cleaning and treatment compositions employing the inventive copolymers that provide effective soap scum resistance to three representative surfaces when used according to the methods of application disclosed herein. Results confirm that the use of the inventive copolymers, as well as cleaning and treatment compositions employing them, enables versatile treatment to provide enhanced substantivity and soap scum resistance benefits to a variety of substrates. The observed water-sheeting effects of the inventive copolymer gels present on treated surfaces, substantivity and resistance to water rinsing, and/or enhanced soap scum resistance correspond to enhanced protective benefits that provide for easier cleaning, easier next-time cleaning, and faster cleaning (i.e. reduced cleaning effort and/or cleaning time) benefits.

TABLE 8

| Composition | Soap Scum Resistance Score | | |
|---|---|---|---|
| # | Acrylic | PVC | Ceramic |
| 7 | 5 | 4 | 4 |
| 9 | 3 | 3 | 3 |
| 11 | 4 | 2 | 3 |
| 17 | 3.5 (1) | 3 | 3.5 (1) |

(1) Scores represent average of two trials.

Hydroscopic Polymer Gel Behavior

FT-IR spectroscopic analysis was also employed in the following experiments to demonstrate the ability of the inventive copolymers to form hydroscopic polymer gels on the surfaces of treated substrates. Using FT-IR spectroscopic techniques allows measurement of deposition of materials onto a surface, measurement of film thickness, and determination of water uptake (hydration) from the environment (air) by the inventive copolymers.

One particularly convenient optical accessory used was a device that is commercially available as the HORIZON from Harrick Scientific Corp., (Ossining, N.Y.). This optical accessory employs internal reflection elements (IREs) with dimensions of 50×10×3 mm. The IRE is mounted horizontally in the HORIZON, at the bottom of a "trough" that can contain about 2.5 ml of liquid. This design allows the IRE to be immersed in a solution and easily rinsed while remaining in place in the FT-IR spectrometer. A wide variety of protocols for treatment of the surfaces of IRE with prototypes and polymer solutions are possible with this accessory. A known volume of cleaning formulation can be applied to the surface of the IRE with a microsyringe and allowed to dry. The FT-IR spectrum of the film formed by the cleaning solution can be obtained. After treatment of the IRE with the cleaning solution, the trough can be filled with water to rinse the treated surface. The water can be rapidly removed from the trough with the use of a pipette tip fitted to the end of a length of tubing to which vacuum is applied. Using this approach, solutions can be rapidly "vacuumed" off the surface of the IRE. The fill and empty procedure constitutes a rinse of the treated IRE surface. Since the IRE surface area and the trough volume are fixed, very reproducible rinsing of treated IREs can be accomplished for the comparison of the effects of compositions by FT-IR spectroscopy.

A convenient method for controlling the water content of the atmosphere over the IRE surface is as follows. A small enclosure (8×3×3 cm) that fits over the exposed trough can be constructed from glass or plastic. Into this enclosure through flexible plastic tubing we direct extremely dry air or nitrogen (dew point approximately −100° F.) at a rate between 5 and 10 SCFH (standard cubic feet per hour). The dry air or nitrogen used can come from the same source used to purge the interior of the FT-IR spectrometer, a typical practice. This approach allows the rapid and very complete drying of the surface of the IRE by covering it with a blanket of dry, flowing gas. In order to expose the IRE surface to the atmosphere, the small enclosure is removed. The FT-IR spectra of the IRE surface in the ambient atmosphere, or under extremely dry conditions, can thus be obtained.

In a typical experiment, twenty microliters of a cleaning composition or polymer solution is spread on the surface of the Ge IRE mounted in the HORIZON. The composition is allowed to dry. The treated surface is then rinsed by filling and emptying the trough with deionized water a number of times, e.g., 12 to 48 times. The rinsing step is used to remove residual components of the cleaning composition that give rise to a visible residue on the surface. A visual inspection of the IRE, which appears smooth and mirror-like, is done to determine if the film or residue on the surface could be seen. The treated surface is then dried by placing the enclosure over the IRE and waiting for at least 2 minutes. The FT-IR spectrum of the polymer gel in the dry atmosphere is then obtained. The enclosure is then removed, and another spectrum of the polymer gel in the ambient atmosphere is obtained. The enclosure can be replaced and removed several times, in order to cycle the gel through water loss and uptake from the atmosphere.

With FT-IR spectroscopy, a "background" or "single beam" spectrum of the clean IRE itself must be recorded first. The single beam spectrum of the IRE after adsorption of the polymers on the surface of the IRE is then recorded, and the final normal spectrum of the polymer gel is then computed from the ratio of these two single beam spectra. In the experiments described herein, the background spectrum of the IRE was obtained under the stream of dry air. The IREs were cleaned before each treatment by polishing with an alumina slurry (0.05 micrometer particles), followed by extensive rinsing with water, methanol, and water again.

Water is readily detected with FT-IR spectroscopy, yielding a characteristic spectrum with intense absorbance (expressed in Absorbance Units or AU) in several wave number ranges. The spectrum of liquid water exhibits absorption between approximately 3700 and 2600 $cm^{-1}$ (wavenumbers), with a maximum near 3370 $cm^{-1}$. This absorption is due to the stretching of the H—O bond of water. The change in the amount of absorbance near this wave number can be used to determine changes in the amount of water on the surface of the IRE caused by the uptake of water from the atmosphere by the polymers of this invention. The overall appearance of the FT-IR spectra can also indicate the presence of the polymer on the surface of the IRE. Different polymers will exhibit different spectra, depending on their chemical structure. The uptake of water from the atmosphere to form the thin gels will always result in the appearance of the characteristic spectrum due to liquid water, however, superimposed on the spectrum of the polymer. The lack of the presence of a polymer on the surface of the IRE can also be detected by the lack of its characteristic spectrum, whether or not the polymer interacts with water. The thickness of the polymer gels that are formed on the surface can be adjusted through proper selection of the components of the inventive compositions. The greater the amount of copolymer that is adsorbed per area on a surface, the greater the amount of water that is taken up by the gels when in contact with the atmosphere. The water uptake and amount of the polymer on the surface can be detected with FT-IR spectroscopy. The visual appearance of the surface remains unchanged when the very thin gels are present, however. Typically, the polymer gel that is formed generates a measurement of greater than 0.0005 Absorbance Units (0.5 milliabsorbance units, mAU) in a Ge internal reflection element cell. In some non-limiting embodiments, the polymer gel generates a measurement of greater than 0.001 Absorbance Units (1.0 mAU) and in yet further non-limiting embodiments greater than 0.005 Absorbance Units (5.0 mAU).

Since the background of the clean IRE is recorded under the dry air blanket, the FT-IR spectrum of the clean IRE surface under the dry air blanket will show essentially no evidence of liquid water, i.e. the absorbance at approximately 3370 $cm^{-1}$ in the spectrum, and indeed across the entire spectrum is essentially 0 AU. The spectrum of the clean IRE was checked in this manner before each experiment, in order to ensure that no significant changes in water content occurred since recording the background spectrum several minutes earlier.

Removal of the blanket and exposure of the clean IRE to the atmosphere will result in the absorption of a very small amount of water as the surface re-equilibrates with the atmosphere. Therefore, there is a small increase in water on the surface of the clean IRE that can be considered a "blank" in the measurement. The increase in the amount of water on the surface in the "blank" measurements was consistently less than 0.5 mAU. The uptake of water by the polymer gels formed from the inventive compositions was measured in the same manner.

Results presented in Table 9 demonstrate the efficacy of the inventive copolymers to hydrate and sequester water from the environment to form polymer gels on treated surfaces. The exposure time indicates the length of time, following complete drying of the copolymer treated model IRE GE surface (purging to provide a background absorbance value reference), that the surface was exposed to the ambient atmosphere, including short exposure times of 5 minutes and overnight (24 hours).

Both compositions and aqueous solutions of the inventive copolymers show the ability to form polymer gels when applied to surfaces and exposed to the environment, whereby they absorb water demonstrated by an increase in the absorbance measured at 3370 $cm^{-1}$. Polymer gels formed by the copolymers appear to fairly rapidly equilibrate with atmospheric moisture and are sufficiently hydroscopic to show significant water uptake within minutes. Longer exposure generally results in increased water levels measured by greater absorbance changes observed, likely as the polymer gel reaches maximum equilibrium with the ambient surroundings. It was further noted that polymer gel formation is reversible, in that water may be "driven off" by purging the copolymer treated articles with dry air for some time, after which exposure to ambient conditions provides for re-hydration of the copolymer to form polymer gels on the surface. Several minutes or longer of dry purging is generally required to obtain a stable background value, indicating that the polymer gels, while reversible in their water uptake depending on treatment conditions, are hydroscopic and tend to retain absorbed water strongly.

TABLE 9

| Composition # | Exposure Time | H-O-H band absorbance change (mAU) (2) 3370 $cm^{-1}$ |
|---|---|---|
| 1 | 5 min. | +1.1 |
| 5 | 5 min. | +1.1 |
| 7 | 5 min. | +0.9 |
| 10 | 24 hrs. | +1.8 |
| 12 | 5 min. | +0.7 |
| 13 | 24 hrs. | +1.3 |
| 18 | 5 min. | +0.8 |
| 19 | 5 min. | +1.3 |
| 20 | 5 min. | +0.8 |
| 21 | 5 min. | +1.2 |
| Polymer F (1) | 5 min. | +1.0 |
| Polymer G (1) | 5 min. | +1.3 |
| Polymer H (1) | 5 min. | +1.1 |
| Polymer I (1) | 5 min. | +0.9 |
| Polymer J (1) | 5 min. | +1.1 |

(1) Copolymer at 1.0 wt % in water at acidic pH.
(2) Difference in absorbance in air vs. purged (dried) system The foregoing has described the principles, preferred non-limiting embodiments, and modes of operation of the present invention. However, the invention should not be construed as limited to the particular embodiments discussed. instead, the above-described embodiments should be regarded as illustrative rather than restrictive, and it should be appreciated that variations may be made in those embodiments by workers skilled in the art without departing from the scope of the present invention led by the following claims.

What is claimed is:

1. A method of forming a hydroscopic polymer gel on a surface that comprises:

(a) applying a water soluble or water dispersible polymer to the surface to form a layer of the polymer on said surface; and (b) allowing water to be sequestered to the layer to form the polymer gel, wherein said polymer gel is not visible and has a thickness that ranges from 0.1 nm to 500 nm, wherein the polymer gel protects said surface against wetting by oil, wherein said polymer comprises:

(1) a water soluble or water dispersible copolymer having:

(i) a first monomer that is acidic and that is capable of forming an anionic charge; and (ii) a second monomer that is an amphipathic monomer that contains at least one hydrophobic moiety and at least one hydrophilic moiety which together define the amphipathic monomer; and (iii) optionally, a third monomer that is hydrophobic; and (iv) optionally, a fourth monomer that has a permanent cationic charge or that is capable of forming a cationic charge on protonation.

2. The method of claim 1 wherein said polymer is adsorbed onto said surface.

3. The method of claim 1 wherein said polymer is not covalently bonded to said surface.

4. The method of claim 1 wherein step (a) comprises the steps of (i) formulating an aqueous composition comprising the water soluble or water dispersible polymer and one or more adjuvant components and (ii) applying the composition on the surface.

5. The method of claim 4 wherein the one or more adjuvant components is selected from the group consisting of dyes, fragrances, buffers, salts, and mixtures thereof.

6. The method of claim 1 wherein step (b) comprises allowing water from the ambient environment to be sequestered to the layer to form the polymer gel.

7. The method of claim 6 wherein the thickness of the polymer gel formed depends on the temperature and relative humidity of the ambient environment.

8. The method of claim 1 wherein the polymer gel creates low water contact angles which results in lowered energy of adhesion of the oil.

9. The method of claim 1 wherein step (a) comprises applying the water soluble or water dispersible polymer onto a hard surface thereby rendering the hard surface hydrophilic.

10. The method of claim 1 wherein step (a) comprises applying the water soluble or water dispersible polymer onto a hard surface thereby forming a polymer gel that is substantive and exhibits a Substantivity score of equal to or greater than 1 to 15.

11. The method of claim 1 wherein step (a) comprises applying the water soluble or water dispersible polymer onto a hard surface thereby forming a polymer gel that exhibits a Soap Scum Repellency score of greater than 1 to 5.

12. The method of claim 9 wherein said hard surface comprises glass, ceramic, metal, tile, flooring, countertop, wall, porcelain, stove top, mirror, wall, painted surface, and/or combinations thereof.

13. The method of claim 9 wherein said hard surface comprises a polymeric substrate selected from the group consisting of polyethylene terephthalate, polyamide, polyurethane, polyester, polyethylene, polyvinyl chloride, chlorinated polyvinylidene chloride, polyacrylamide, polystyrene, polypropylene, polycarbonate, polyaryletherketone, poly(cyclohexylene dimethylene cyclohexanedicarboxylate), poly (cyclohexylene dimethylene terephthalate), poly (cyclohexylene dimethylene terephthalate) glycol, polyetherimide, polyethersulfone, poly(ethylene terephthalate) glycol, polyketone, poly(oxymethylene), polyformaldehyde), poly(phenylene ether), poly(phenylene sulfide), poly (phenylene sulfone), polystyrene, polysulfone, polytetrafluoroethylene, polyurethane, poly(vinylidene fluoride), polyamide, polyamide thermoplastic elastomer, polybutylene, polybutylene terephthalate, polypropylene terephthalate, polyethylene naphthalate, polyhydroxyalkanoate, polyacrylate, poly(methyl)methacrylate, polytrimethylene terephthalate, polyvinylchloride, polyvinylidene chloride, copolyester thermoplastic elastomer, olefinic thermoplastic elastomer, styrenic thermoplastic elastomer, urethane thermoplastic elastomer, thermoplastic rubber vulcanisate, rubber, neoprene, vinyl, silicone elastomer, and combinations thereof.

14. The method of claim 9 wherein said surface comprises a polymeric substrate comprising one or more monomers selected from the group consisting of acrylate, acrylonitrile, butadiene, ethylene, formaldehyde, maleic anhydride, melamine, methacrylate, methyl methacrylate, phenol, propylene, styrene, urethane, vinyl acetate, and combinations thereof.

15. The method of claim 1 wherein step (a) comprises applying the water soluble or water dispersible polymer onto the surface of fabric.

16. The method of claim 1, wherein step (a) comprises applying a composition that comprises:

(1) a water soluble or water dispersible copolymer having:
  (i) a first monomer that is acidic and that is capable of forming an anionic charge in the composition;
  (ii) a second monomer that is amphipathic;
  (iii) optionally, a third monomer that is hydrophobic and
  (iv) optionally, a fourth monomer that has a permanent cationic charge or that is capable of forming a cationic charge on protonation;
(2) an aqueous carrier;
(3) optionally, an organic solvent; and
(4) optionally, an adjuvant.

17. The method of claim 16 wherein the copolymer comprises a first monomer and a second monomer, wherein the mole ratio of the first monomer to second monomer ranges from 25:1 to 1:25.

18. A method of forming a hydroscopic polymer gel on a surface that comprises:

(a) applying a water soluble or water dispersible polymer to the surface to form a layer of the polymer on said surface; and
(b) allowing water to be sequestered to the layer to form the polymer gel, wherein said polymer gel is not visible and has a thickness that ranges from 0.1 nm to 500 nm, wherein the polymer gel protects said surface against wetting by oil, wherein said polymer comprises:
  (1) a water soluble or water dispersible copolymer having:
    (i) a first monomer that is acidic and that is capable of forming an anionic charge; and
    (ii) a second monomer that is an amphipathic monomer that contains at least one hydrophobic moiety and at least one hydrophilic moiety which together define the amphipathic monomer having the formula $$[A]_nB(C)_mLW \qquad \text{I}$$

wherein A comprises a hydrophobic radical having n total number of carbon atoms;

n being from 4 to 100;

wherein A comprises a branched hydrocarbon radical subunit selected from the group consisting an alkyl, alkylene, aryl, alkylaryl, benzyl, phenyl, polycyclic aromatic hydrocarbons, and/or derivatives thereof;

wherein B comprises an interatomic bond or a linkage group selected from —O—, —S—,—C(O)—, —C(O)C(O)—, —C(O)$CH_2$C(O)—, —NR1C(O)—, —C(O)O—, —OC(O)—, —C(O)O$(CH_2)_p$— and —$(CH_2)_p$—;

p being from 1 to 6;

$(C)_m$ comprising a hydrophilic moiety selected from —NH—, —SH—, —C(O)O—, —OC(O)—, —C(O)O$(CH_2)_p$— and —O—[(CR1R2)$_i$—O]$_j$—;

m being from 1 to 5;

i being from 1 to 3;

j being from 1 to about 50;

wherein L comprises a tether group selected from —C(O)—, —C(O)C(O)—,—C(O)$CH_2$C(O)—, —NR1C(O)—, —C(O)O—, —OC(O)—, —C(O)O$(CH_2)_p$— and —$(CH_2)_p$— and —$(CH_2)_p$—;

wherein W comprises a polymerizable alkylene group selected from —(R1C═CR2)— and (R1R2C═CR3)—;

wherein R1, R2, R3 are independently selected from —H, —$CH_3$ and —$(CH_2)_k$—, —X, phenyl;

k being from 1 to about 6;

wherein X is selected from Cl , F, Br and I;

wherein the ratio of the molar mass of A to molar mass of C is between 10:1 and 1:10

(iii) optionally, a third monomer that is hydrophobic; and (iv) optionally, a fourth monomer that that has a permanent cationic charge or that is capable of forming a cationic charge on protonation.

19. The method of claim 18 wherein said first monomer is selected from the group consisting of acrylic acid, methacrylic acid, ethacrylic acid, laurylacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfoethyl acrylic acid, styrenesulfonic acid, 2-methacryloyloxymethane- 1 -sulfonic acid, 3-methacryloyloxypropane- 1- sulfonic acid, 3 -(vinyloxy)propane- 1 -sulfonic acid, ethylenesulfonic acid, vinyl sulfuric acid, 4-vinylphenyl sulfuric acid, ethylene phosphonic acid and vinyl phosphoric acid.

20. The method of claim 18 wherein said second amphipathic monomer is selected from the group consisting of tert-butylaminoethylmethyacrylate, branched alkyl alkylacrylates, tristyryl phenol-capped poly(ethylene oxide) ester of methacrylic acid, tristyryl poly(ethylene oxide) ester of methacrylic acid, and combinations thereof.

21. The method of claim 20 wherein said second amphipathic monomer comprises a group having a formula selected from:

XI

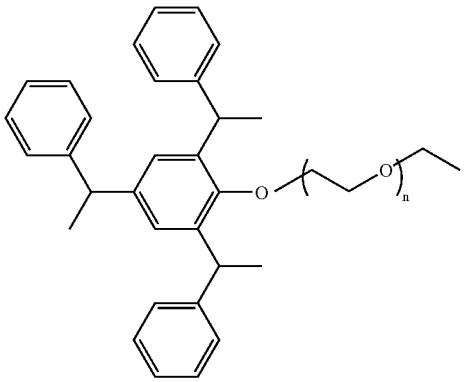

and

-continued

XII

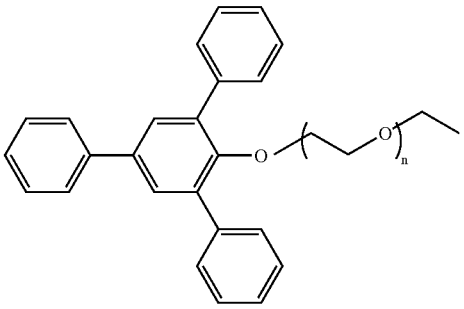

wherein n is from 1 to 100.

22. The method of claim 18 wherein the copolymer includes a third monomer and the mole ratio of said first monomer to said third monomer ranges from 10:1 to 1:10.

23. The method of claim 18 wherein the copolymer includes a fourth monomer and the mole ratio of said first monomer to said fourth monomer ranges from 10:1 to 1:10.

24. The method of claim 22 wherein said third monomer is selected from a group having the formula:

$[A2]_{n'}$.LW XII wherein n' represents the total number of carbon and/or silicone atoms in said A2 group, n' being from 1 to about 1000;

wherein A2 comprises a hydrophobic radical selected from the group consisting of A, alkylsilane, alkoxysilane, alkylsiloxane, alkoxysiloxane, aminosiloxane, organosiloxane, silazane, silane, organo-H-silane, silicone, silsesquioxane, periluoroalkane, fluorooxetanes, perfluoroalkyl-silane, perfluorosilane, perfluoroalkyl-siloxane, periluoroalkoxyl-siloxane, perfluoro-siloxane, and/or mixtures thereof.

25. The method of claim 23 wherein said fourth monomer is selected from the group consisting of acrylamide, N,N-dimethylacrylamide, methacrylamide, N,N-dimethylmethacrylamide, N,N-di-isopropylacrylamide, N-vinylimidazole, N-vinylpyrrolidone, dialkylaminoethylmethacrylate, dialkylaminoethylacrylate, dialkylaminopropylmethacrylate, dialkylaminopropylacrylate, dialkylamino-ethylmethacrylamide, dialkylaminoethylacrylamide, dialkylaminopropyl-methacrylamide, dialkylaminopropylacrylamide, N-alkyl, N-vinylimidazolium, N-alkyl, N-vinylpyrrolidonium, trialkylammoniumethylmethacrylate, trialkylammoniumethylacrylate, trialkylammoniumpropylmethacrylate, trialkylammoniumpropylacrylate, trialkylammoniumethylmethacrylamide, trialkylammoniumethylacrylamide, trialkylammoniumpropylmethacrylamide, trialkylammoniumpropylacrylamide, di-quatemary derivatives of methacrylamide, and/or mixtures thereof.

26. The method of claim 16 wherein said composition further comprises a surfactant.

27. The method of claim 26 wherein said surfactant is nonionic.

28. The method of claim 16 wherein said composition further comprises an adjuvant that is selected from the group consisting of buffering agents, builders, hydrotropes, fragrances, dyes, colorants, odor control agents, disinfectants, germicides, solubilizing materials, stabilizers, thickeners, defoamers, enzymes, bleaching agents, cloud point modifiers, preservatives, and mixtures thereof.

29. The method of claim 16 wherein said composition further comprises an organic solvent.

30. The method of claim 16 wherein said copolymer comprises from 0.01% to 20% by weight of the composition.

31. The method of claim 16 wherein said copolymer comprises from 0.1% to 5% by weight of the composition.

32. The method of claim 16 wherein said composition comprises at least 70% by weight water.

33. The method of claim 26 wherein said surfactant comprises from 0.01% to 10% by weight of the composition.

34. The method of claim 29 wherein said solvent comprises from 0.01% to 10% by weight of the composition.

35. The method of claim 1 wherein said polymer gel that is formed generates a measurement of greater than 0.0005 Absorbance Units in a germanium internal reflection element cell.

36. The method of claim 1 wherein said polymer gel generates a measurement of greater than 0.001 Absorbance Units in a germanium internal reflection element cell.

37. The method of claim 1 wherein said polymer gel generates a measurement of greater than 0.05 Absorbance Units in a germanium internal reflection element cell.

38. The method of claim 16 wherein step (a) comprises (i) applying an aqueous composition comprising said water soluble or water dispersible polymer onto the surface and (ii) removing a majority of said aqueous composition to form the layer of polymer.

39. The method of claim 18 wherein said hydrophobic radical of said second monomer comprises a radical having a formula selected from:

II

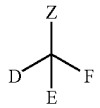

III

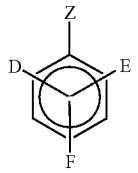

and

IV

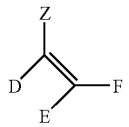

wherein Z comprises an interatomic bond or a linkage group selected from —O—, —S—, —C(O)—, —C(O)C(O)—, —C(O)$CH_2$C(O)—, —NR1C(O)—, —C(O)O—, —OC(O)—, —C(O)O(CH2)$_p$— and —(CH2)$_p$—;

wherein p is 1 to 6;

wherein D, E, F are radicals independently selected from hydrogen, fluorine, chlorine, bromine, alkyl, alkylene, aryl, arylalkyl, benzyl, phenyl, and/or combinations thereof;

wherein if any one of D, E, and F is not a single atomic substituent, then D, E, and F independently are groups having between 1 to 50 carbon atoms;

wherein said D, E, and F substituents said hydrophobic radical IV may independently occupy any individual attachment site at a ring carbon position, in any order said attachment site selected from ortho, meta and para positions with respect to the Z group ring position.

40. The method of claim 18 wherein said hydrophobic radical of said second monomer comprises a radical having the formula:

VI

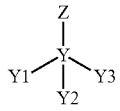

wherein Y comprises a single dendritic initiator core group subunit;

wherein Y is a multivalent group selected from carbon, nitrogen, sulfur, phosphorous, alkyl, alkylene, aryl, arylalkyl, benzyl, phenyl, and/or derivatives thereof;

wherein at least two of Y 1, Y2 and/or Y3 are first generation branch groups, and/or termination surface groups);

wherein Y1, Y2 and Y3 comprise radicals having the formula:

VII

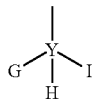

wherein G, H, I comprise groups independently selected from D, E, and F;

wherein D, E, F are radicals independently selected from hydrogen, fluorine, chlorine, bromine, alkyl, alkylene, aryl, arylalkyl, benzyl, phenyl, and/or combinations thereof;

wherein if any one of D, E, and F is not a single atomic substituent, then D, E, and F independently are groups having between 1 to 50 carbon atoms.

* * * * *